US011357371B2

(12) United States Patent
Lewis et al.

(10) Patent No.: US 11,357,371 B2
(45) Date of Patent: Jun. 14, 2022

(54) MOBILE CLEANING ROBOT WITH A BIN

(71) Applicant: iRobot Corporation, Bedford, MA (US)

(72) Inventors: Oliver Lewis, Waltham, MA (US); Stephen A. Hickey, Somerville, MA (US); Russell Walter Morin, Burlington, MA (US)

(73) Assignee: iRobot Corporation, Bedford, MA (US)

( * ) Notice: Subject to any disclaimer, the term of this patent is extended or adjusted under 35 U.S.C. 154(b) by 655 days.

(21) Appl. No.: 16/371,929

(22) Filed: Apr. 1, 2019

(65) Prior Publication Data

US 2019/0223670 A1 Jul. 25, 2019

Related U.S. Application Data

(63) Continuation of application No. 15/338,164, filed on Oct. 28, 2016, now Pat. No. 1,029,554.

(51) Int. Cl.
*A47L 9/10* (2006.01)
*A47L 9/12* (2006.01)
(Continued)

(52) U.S. Cl.
CPC ..... *A47L 9/009* (2013.01); *A47L 9/106* (2013.01); *A47L 9/122* (2013.01); *A47L 9/1409* (2013.01);
(Continued)

(58) Field of Classification Search
CPC ..... A47L 9/009; A47L 9/106; A47L 9/122; A47L 9/1409; A47L 9/1463;
(Continued)

(56) References Cited

U.S. PATENT DOCUMENTS 578,634 A 3/1897 Gooding et al.
5,638,838 A 6/1997 Lombardi
(Continued)

FOREIGN PATENT DOCUMENTS

AU 2017350549 10/2018
CN 102525335 7/2012
(Continued)

OTHER PUBLICATIONS

"Chinese Application Serial No. 201611243504.1, Office Action dated Oct. 29, 2020", w English translation, 24 pgs.
(Continued)

*Primary Examiner* — David Redding
(74) *Attorney, Agent, or Firm* — Schwegman Lundberg & Woessner, P.A.

(57) ABSTRACT

This document describes a mobile cleaning robot including a chassis having a forward portion and an aft portion; a blower affixed to the chassis; a bin supported by the chassis and configured to receive airflow from the blower, the chassis enabling evacuation of the bin through a bottom of the robot. The bin includes a top, a bottom, a sidewall, and an internal barrier. The bin includes a first volume and a second volume separated by the internal barrier and a filter unit supported by the internal barrier and removably disposed in an airflow path between the first volume that includes an intake port in the bin and the second volume that includes an exhaust port in the bin.

27 Claims, 20 Drawing Sheets

(51) Int. Cl.
*A47L 9/14* (2006.01)
*A47L 9/00* (2006.01)

(52) U.S. Cl.
CPC ..... *A47L 9/1463* (2013.01); *A47L 2201/00* (2013.01); *A47L 2201/04* (2013.01)

(58) Field of Classification Search
CPC .. A47L 2201/00; A47L 2201/04; A47L 9/102; A47L 2201/024; A47L 11/24; A47L 11/40; A47L 11/4013; A47L 11/4027
See application file for complete search history.

(56) References Cited

U.S. PATENT DOCUMENTS

| | | | |
|---|---|---|---|
| 6,389,329 | B1 | 5/2002 | Colens |
| 6,532,404 | B2 | 3/2003 | Colens |
| 6,594,844 | B2 | 7/2003 | Jones |
| 6,690,134 | B1 | 2/2004 | Jones et al. |
| 6,781,338 | B2 | 8/2004 | Jones et al. |
| 6,809,490 | B2 | 10/2004 | Jones et al. |
| 6,965,209 | B2 | 11/2005 | Jones et al. |
| 7,155,308 | B2 | 12/2006 | Jones |
| 7,173,391 | B2 | 2/2007 | Jones et al. |
| 7,196,487 | B2 | 3/2007 | Jones et al. |
| 7,388,343 | B2 | 6/2008 | Jones et al. |
| 7,389,156 | B2 | 6/2008 | Ziegler et al. |
| 7,448,113 | B2 | 11/2008 | Jones et al. |
| 7,571,511 | B2 | 8/2009 | Jones et al. |
| 7,636,982 | B2 | 12/2009 | Jones et al. |
| 7,761,954 | B2 | 7/2010 | Ziegler |
| 8,239,992 | B2 | 8/2012 | Schnittman et al. |
| 8,732,901 | B2 | 5/2014 | Shim et al. |
| 8,741,013 | B2 | 6/2014 | Swett et al. |
| 9,220,386 | B2 | 12/2015 | Gilbert, Jr. et al. |
| 9,320,400 | B2 | 4/2016 | Gilbert, Jr. et al. |
| 10,292,554 | B2 | 5/2019 | Lewis et al. |
| 2002/0016649 | A1 | 2/2002 | Jones |
| 2002/0120364 | A1 | 8/2002 | Colens |
| 2003/0025472 | A1 | 2/2003 | Jones et al. |
| 2004/0020000 | A1 | 2/2004 | Jones |
| 2004/0049877 | A1 | 3/2004 | Jones et al. |
| 2004/0074044 | A1 | 4/2004 | Diehl et al. |
| 2004/0187457 | A1 | 9/2004 | Colens |
| 2004/0207355 | A1 | 10/2004 | Jones et al. |
| 2005/0067994 | A1 | 3/2005 | Jones et al. |
| 2005/0204717 | A1 | 9/2005 | Colens |
| 2007/0266508 | A1 | 11/2007 | Jones et al. |
| 2008/0140255 | A1 | 6/2008 | Ziegler et al. |
| 2008/0155768 | A1 | 7/2008 | Ziegler et al. |
| 2008/0276407 | A1 | 11/2008 | Schnittman et al. |
| 2008/0307590 | A1 | 12/2008 | Jones et al. |
| 2010/0049365 | A1 | 2/2010 | Jones et al. |
| 2010/0257690 | A1 | 10/2010 | Jones et al. |
| 2010/0257691 | A1 | 10/2010 | Jones et al. |
| 2010/0263158 | A1 | 10/2010 | Jones et al. |
| 2012/0023699 | A1 | 2/2012 | Shim et al. |
| 2012/0095597 | A1 | 4/2012 | Kim et al. |
| 2012/0199006 | A1 | 8/2012 | Swett et al. |
| 2013/0232718 | A1 | 9/2013 | Baek et al. |
| 2014/0379127 | A1 | 12/2014 | Tsuboi et al. |
| 2015/0250371 | A1 | 9/2015 | Jang et al. |
| 2016/0166126 | A1 | 6/2016 | Morin et al. |
| 2016/0278596 | A1 | 9/2016 | Janzen et al. |
| 2017/0020355 | A1 | 1/2017 | Wennerstrom |
| 2018/0116478 | A1 | 5/2018 | Lewis et al. |

FOREIGN PATENT DOCUMENTS

| | | |
|---|---|---|
| CN | 103491838 | 1/2014 |
| CN | 204445696 | 7/2015 |
| CN | 105078362 | 11/2015 |
| CN | 205306910 | 6/2016 |
| CN | 105848545 | 8/2016 |
| CN | 105848549 | 8/2016 |
| CN | 105942931 | 9/2016 |
| EP | 3531886 | 9/2019 |
| JP | H0686750 | 12/1994 |
| JP | 2001157654 | 6/2001 |
| JP | 2004049801 | 2/2004 |
| JP | 2005237732 | 9/2005 |
| JP | 2010012126 | 1/2010 |
| JP | 2010081968 | 4/2010 |
| JP | 2010526594 | 8/2010 |
| JP | 2014512246 | 5/2014 |
| JP | 2017500094 | 1/2017 |
| JP | 6636649 | 12/2019 |
| WO | WO 2013/105431 | 7/2013 |
| WO | 2015077802 | 5/2015 |
| WO | 2015082019 | 6/2015 |
| WO | WO 2015/090439 | 6/2015 |
| WO | 2016093911 | 6/2016 |
| WO | 2018080766 | 5/2018 |

OTHER PUBLICATIONS

"Japanese Application Serial No. 2019-227514, Notification of Reasons for Refusal dated Apr. 5, 2021", w English Translation, 15 pgs.
U.S. Appl. No. 15/338,164, filed Oct. 28, 2016, Mobile Cleaning Robot With a Bin.
U.S. Appl. No. 10.292,554.
"European Application Serial No. 17864186.6, Extended European Search Report dated Sep. 4, 2020", 11 pgs.
"U.S. Appl. No. 15/338,164, Non Final Office Action dated Sep. 11, 2018", 21 pgs.
"U.S. Appl. No. 15/338,164, Response filed Dec. 11, 2018 to Non Final Office Action dated Sep. 11, 2018", 10 pgs.
"U.S. Appl. No. 15/338,164, Notice of Allowance dated Jan. 7, 2019", 5 pgs.
"U.S. Appl. No. 15/338,164, Corrected Notice of Allowability dated Feb. 12, 2019", 2 pgs.
"U.S. Appl. No. 15/338,164, 312 Amendment filed Mar. 14, 2019", 11 pgs.
"U.S. Appl. No. 15/338,164, PTO Response to Rule 312 Communication dated Mar. 28, 2019", 2 pgs.
"Japanese Application Serial No. 2018-550695, Voluntary Amendment and PPH Request filed Jul. 22, 2019", w English claims, 11 pgs.
"European Application Serial No. 17864186.6, Response filed Dec. 10, 2019 to Communication Pursuant to Rules 161(1) and 162 EPC dated Jun. 5, 2019", 9 pgs.
"European Application Serial No. 17864186.6, Partial Supplementary European Search Report dated Jun. 3, 2020", 12 pgs.
"Facts on the Trilobite," Electrolux, accessed online <http://trilobite.electrolux.se/presskit_en/node1335.asp?print=yes&pressID=> Dec. 12, 2003, 2 pages.
"Welcome to the Electrolux Trilobite," Electrolux, accessed online <http://electroluxusa.com/node57.asp?currentURL=node142.asp%3F> Mar. 18, 2005, 2 pages.
Doty, K. L., and Harrison, R. R., Sweep Strategies for a Sensory-Driven, Behavior-Based Vacuum Cleaning Agent, AAAI 1993 Fall Symposium Series, Instantiating Real-World Agents, Research Triangle Park, Raleigh, NC, Oct. 22-24, 1993, pp. 1-6.
Everett, H.R. (1995). Sensors for Mobile Robots. AK Peters, Ltd., Wellesley, MA.
HITACHI: News release: The home cleaning robot of the autonomous movement type (experimental machine) is developed. May 29, 2003. Accessed online Mar. 18, 2005 <http://www.i4u.com/japanreleases/hitachirobot.htm> 5 pages.
Honda Motor Co., Ltd., English Translation of JP11212642, Aug. 9, 1999, 31 pages.
International Search Report and Written Opinion in International Application PCT/US2017/55646, dated Jan. 12, 2018, 12 pages.
Jones, J., Roth, D. Robot Programming: A Practical Guide to Behavior-Based Robotics. McGraw-Hill Education TAB, Jan. 2, 2004, 288 pages.

(56) References Cited

OTHER PUBLICATIONS

Karcher RC 3000 Robotic Cleaner, Product page, accessed online <http://www.karcher-usa.com/showproducts.php?op=view_prod&param1=143&param2=&param3=> Mar. 18, 2005, 3 pages.
Karcher RoboCleaner RC 3000, Dec. 12, 2003, 4 pages.
Karcher, Product Manual Download, 2003, 16 pages.
Neato Botvac™ User Manual, Neato Robotics, Sep. 11, 2014.
Prassler, et al., English Translation of DE19849978, Feb. 8, 2001, 16 pages.
International Report on Patentability in International Application PCT/US2017/55646, dated Apr. 30, 2019, 10 pages.
"Chinese Application Serial No. 201611243504.1, Decision of Rejection dated Dec. 2, 2021", w/ English translation, 27 pgs.

MOBILE CLEANING ROBOT WITH A BIN

CROSS-REFERENCE TO RELATED APPLICATIONS

This application is a continuation of and claims priority to U.S. application Ser. No. 15/338,164, filed on Oct. 28, 2016, the disclosure of which is incorporated by reference in its entirety.

TECHNICAL FIELD

This specification relates to a bin for a mobile cleaning robot.

BACKGROUND

A mobile cleaning robot can navigate over a surface such as a floor and clean debris from the surface. Once collected, the debris can be stored in a volume inside the robot and later removed.

SUMMARY

In one aspect, a mobile cleaning robot includes a chassis having a forward portion and an aft portion, a blower affixed to the chassis, a bin supported by the chassis and configured to receive airflow from the blower, the chassis enabling evacuation of the bin through a bottom of the robot. The bin includes a bin formed of a rigid material comprising a top, a bottom, a sidewall, and an internal barrier. In one aspect, the bin defines a first volume and a second volume separated by the internal barrier. The bin includes a filter unit supported by the internal barrier and removably disposed in an airflow path between the first volume that includes an intake port in the bin and the second volume that includes an exhaust port in the bin.

Certain aspects include one or more implementations described herein and elsewhere.

In some implementations, the internal barrier includes support beams configured to receive the filter unit within the second volume and to allow airflow between the first volume and the second volume, the support beams being at an angled plane allowing the debris intake port to be proximate to the top of the bin and the exhaust port included in the second volume to be proximate to the top of the bin.

In some implementations, the mobile cleaning robot includes a leaf spring affixed within the second volume and proximate the internal barrier and being mechanically compressible to exert a retention force on the received filter unit. In some implementations, the mobile cleaning robot includes a prescreen filter disposed beneath the received filter unit in the airflow path between the first volume and the second volume. In some implementations, the filter unit includes a filter material supported by a frame having integrated protrusions, the protrusions aligning the frame within slots in the internal barrier. In some implementations, the filter unit includes a rigid pull-tab protruding from the frame.

In some implementations, the top of the bin includes a filter door hingedly attached and positioned to allow access to the filter unit disposed in the airflow path. In some implementations, the mobile cleaning robot includes a button being pressable from above the top of the bin and being configured to release a latch to open the bottom of the bin when the button is pressed.

In some implementations, the mobile cleaning robot includes a handle hingedly attached to the top of the bin, the handle extending above the top in an extended state and being disposed in a recess of the top of the bin during a stored state. The mobile cleaning robot further includes a bin emptying button disposed in the recess, the handle configured to cover the button during the stored state. In some implementations, the top of the handle extends less than 5 inches above the top of the bin in the extended state and is positioned less than 5 inches from the button in the stored state.

In some implementations, the bottom of the bin is hingedly attached to the sidewall of the bin and is configured to couple with a button-actuated latch for releasing a non-hinged edge of the bottom of the bin. In some implementations, the bottom of the bin includes a resistance mechanism configured to retard opening of the bottom of the bin. The bottom of the bin can be re-attachable and configured to detach when the bottom door is opened beyond an operating angle. In some implementations, the bottom of the bin includes a movable barrier for evacuation of contents of the bin, the movable barrier being configured to open when a suction force is applied to the movable barrier from outside of the bin.

In some implementations, the bottom surface of the mobile cleaning robot includes a breakaway segment for exposing the movable barrier, the breakaway segment and the movable barrier being aligned with the movable barrier. In some implementations, the debris intake port is disposed in the sidewall of the bin of the first volume and the exhaust port is disposed in the sidewall of the bin of the second volume, the debris intake port and the exhaust port being offset from a centerline of the bin, the airflow path being from the debris intake port across the centerline of the bin and across the internal barrier through the filter unit to the exhaust port, the centerline extending between the forward portion and the aft portion.

In some implementations, the mobile cleaning robot includes a seating in the chassis for supporting the bin; and a bin access panel hingedly connected to the chassis and configured to cover the bin when the bin is properly seated, the bin access panel being ajar when the bin is improperly seated, the bin being configured to provide tactile feedback when the bin is properly inserted into the seating. In some implementations, the sidewall of the bin includes a shape feature configured to match a complementary shape in the seating, the sidewall being angled to match a tapered sidewall of the seating, the tapered sidewall guiding insertion of the bin into the seating to align a movable barrier of the bottom of the bin with a breakaway segment of the chassis. In some implementations, the alignment of the movable barrier of the bottom of the bin with the breakaway segment of the chassis is within a 1 millimeter tolerance. In some implementations, the bin includes a filter presence sensing assembly. The filter presence sensing assembly can include a lever arm including a magnet and a hall sensor, the magnet being in a low position away from the hall sensor when the filter unit is not present in the bin and the magnet being in a lifted position when the filter unit is installed in the bin.

Advantages of the foregoing may include, but are not limited to, those described below and herein elsewhere. The precise positioning of the bin in the mobile cleaning robot reduces the amount of suction lost by gaps in the pneumatic airflow path in the mobile cleaning robot. The bin can be removed easily from the mobile cleaning robot using the handle. The filter unit is fasted securely in place, but can be removed without much effort by the user and without exposure to the debris inside the bin. The prescreen filter prevents larger particles of debris from contacting the filter unit and prevents buildup of debris on the filter material. The shape of the bin allows the bin to backfill with debris and extend operating time before evacuation of the bin is needed. The bin can be evacuated autonomously.

The details of one or more implementations of the subject matter described in this specification are set forth in the accompanying drawings and the description below. Other potential features, aspects, and advantages will become apparent from the description, the drawings, and the claims.

BRIEF DESCRIPTION OF THE DRAWINGS

Like reference numbers and designations in the various drawings indicate like elements.

DETAILED DESCRIPTION

Figure 1A:
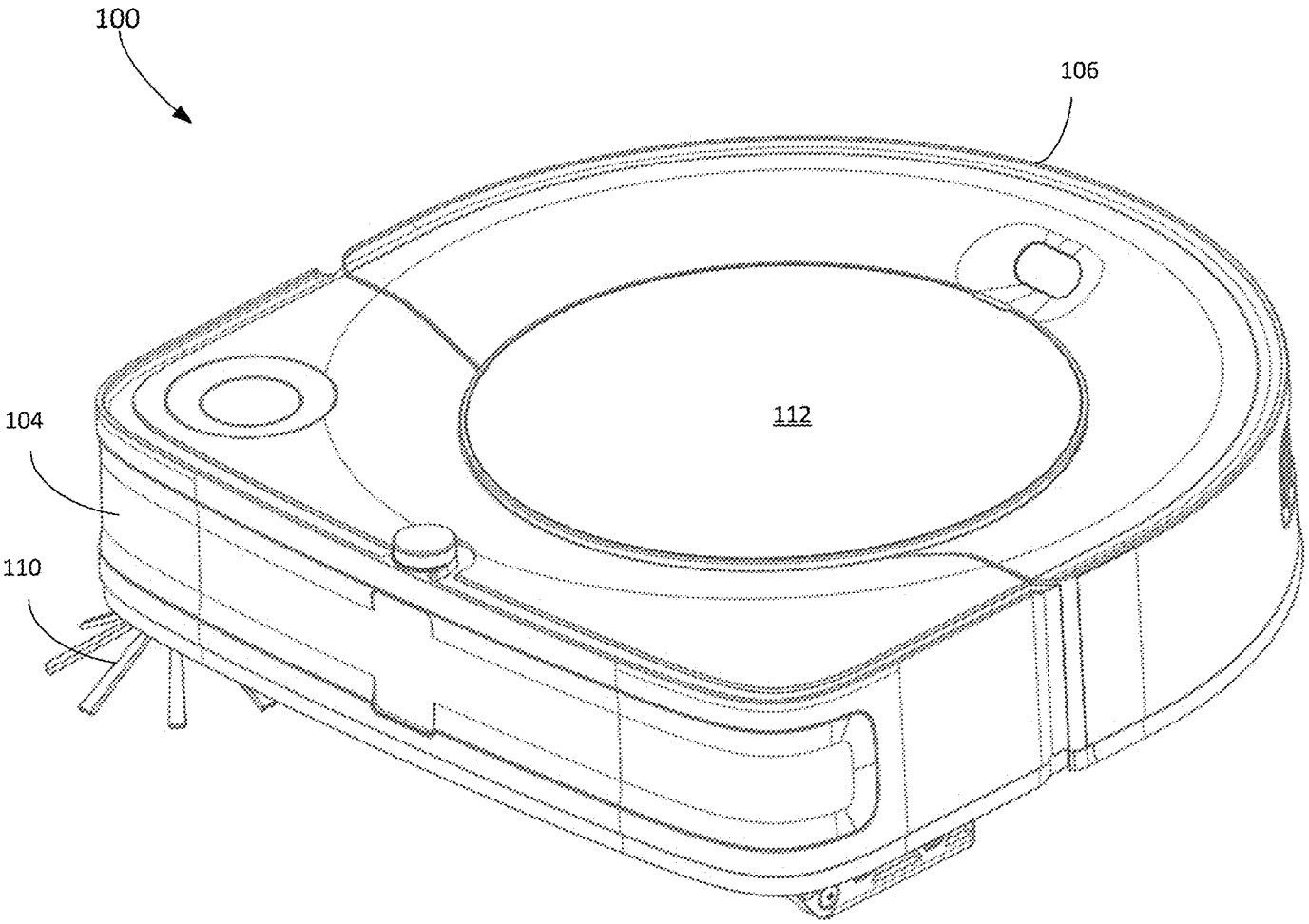
FIG. 1A is a top isometric view of an exemplary mobile cleaning robot.

A mobile cleaning robot can navigate around a room or other locations and clean a surface over which it moves. In some implementations, the robot navigates autonomously, however user interaction may be employed in certain instances. The mobile cleaning robot collects dust and debris from the surface and stores the dust and debris in a bin (e.g., a debris bin) that can be later emptied (e.g., at a later time when the bin is at or near capacity). The bin is designed for removal and emptying by a user, automatic evacuation by an evacuation device, or manual evacuation by a handheld vacuum means external to the robot. The bin rests inside the mobile cleaning robot and is positioned in an airflow path through the mobile cleaning robot for retaining debris vacuumed into the bin by the airflow. The airflow path assists in pulling debris from the surface, through the mobile cleaning robot and into the bin. The bin filters the air and a blower expels the filtered air through a vent (e.g., vent 220 shown in FIG. 9) in the mobile cleaning robot.

FIGS. 1A-2A shows an exemplary mobile cleaning robot 100 that can autonomously navigate a cleaning surface and perform cleaning operations (e.g., vacuum operations) on the cleaning surface. The mobile cleaning robot 100 had a forward portion 104 and an aft portion 106. The mobile cleaning robot 100 includes elements such as a bin 108 (e.g., a debris bin), a blower 118 (e.g., a vacuum source), a cleaning head 120, a drive system for moving the mobile cleaning robot 100, the drive system including left and right drive wheels 194A, 194B, a corner brush 110, cliff detection sensors 195A-195D, a recessed optical mouse sensor 197 aimed at the floor surface for detecting drift, and a rear caster wheel 196. In some implementations of the mobile cleaning robot 100, the forward portion 104 is square cornered with a substantially flat leading edge and the aft portion 106 is a rounded or semi-circular trailing edge, giving the mobile cleaning robot 100 a D-shaped or tombstone-shaped peripheral profile. In other implementations, the mobile robot 100 may have another peripheral profile shape such as a round profile, a triangular profile, an elliptical profile or some non-symmetrical and/or non-geometric shape or industrial design.

Figure 1B:
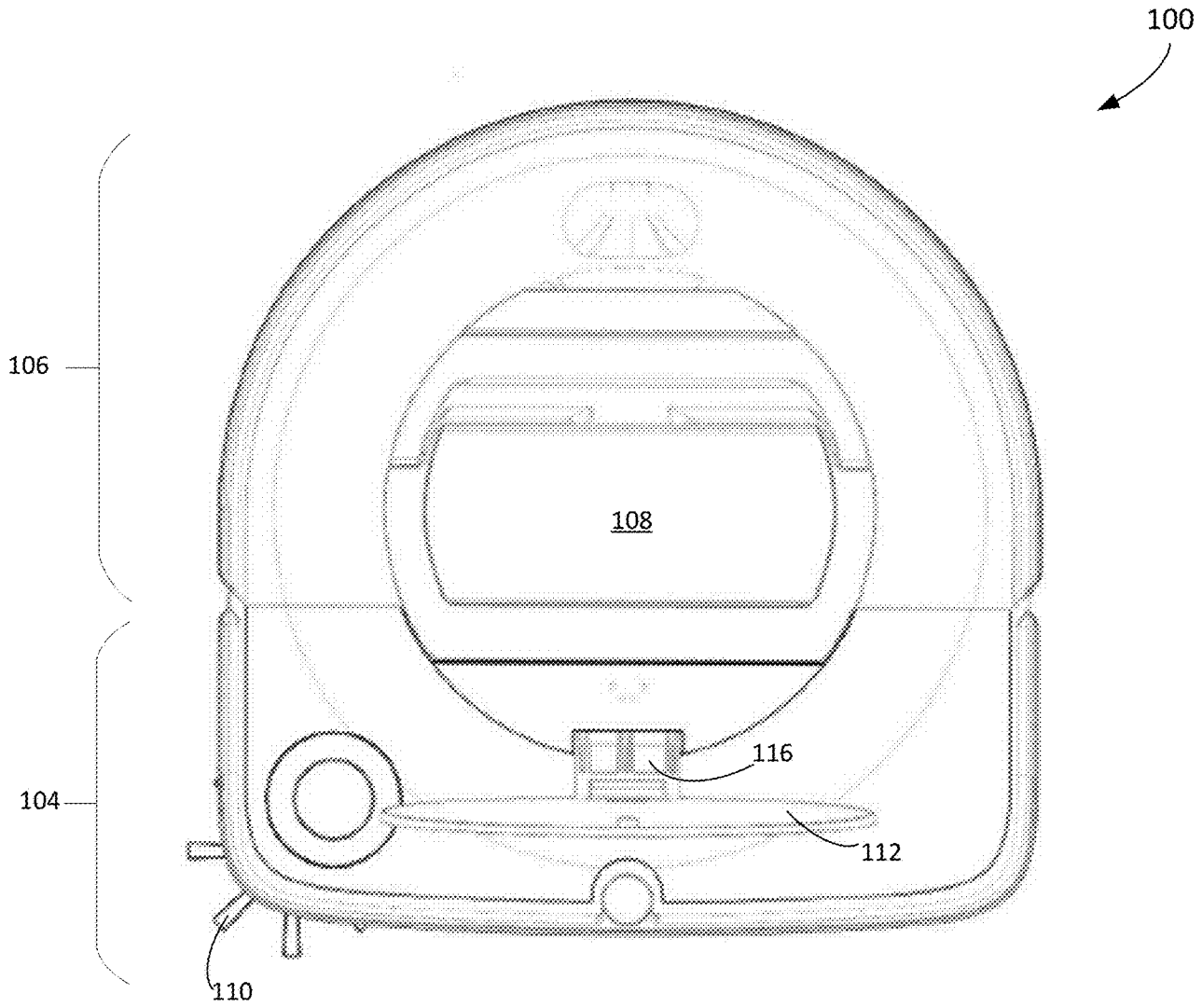
FIG. 1B is a top view of an exemplary mobile cleaning robot.
Figure 1C:
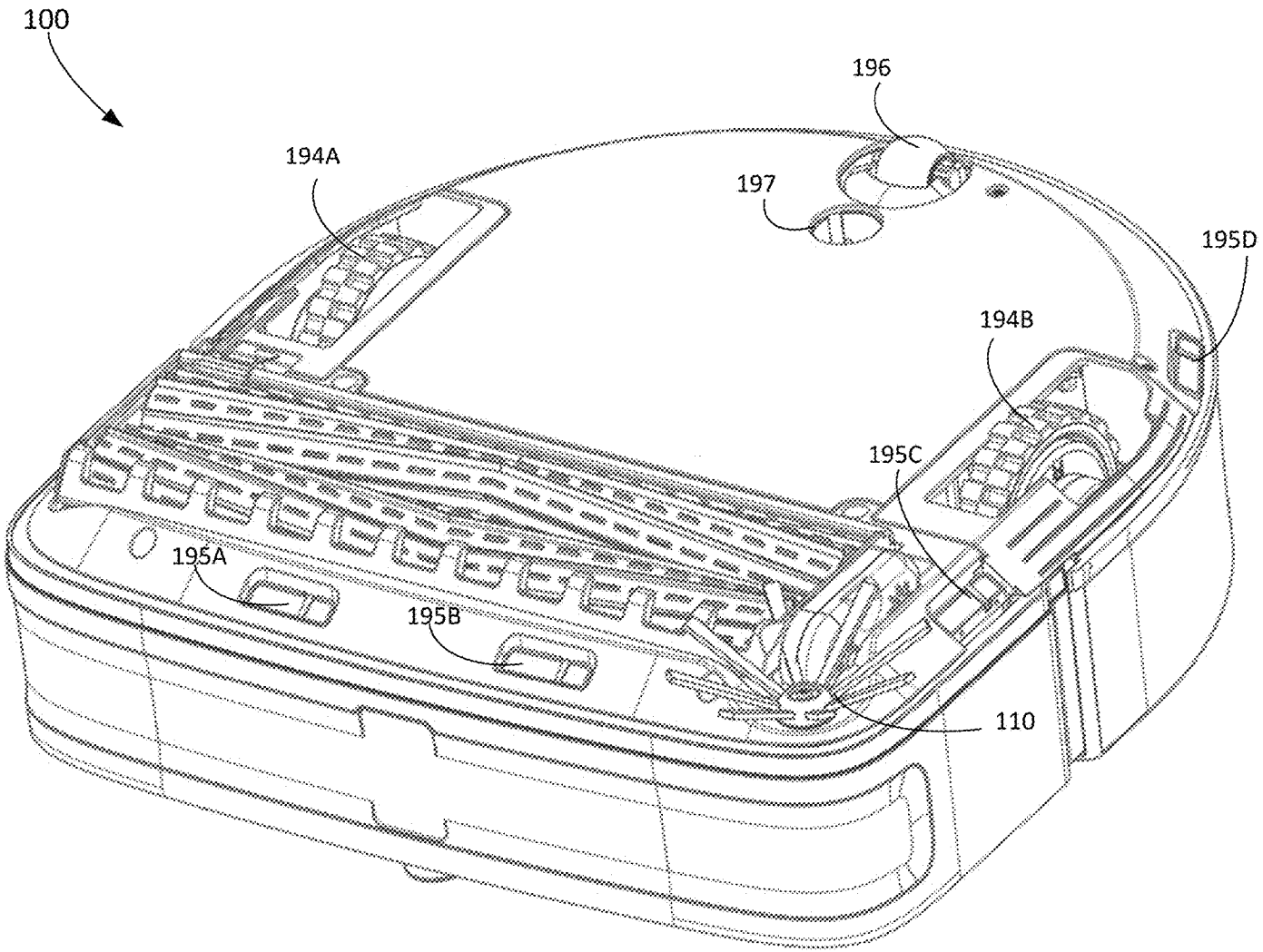
FIG. 1C is a bottom view of an exemplary mobile cleaning robot.
Figure 1D:
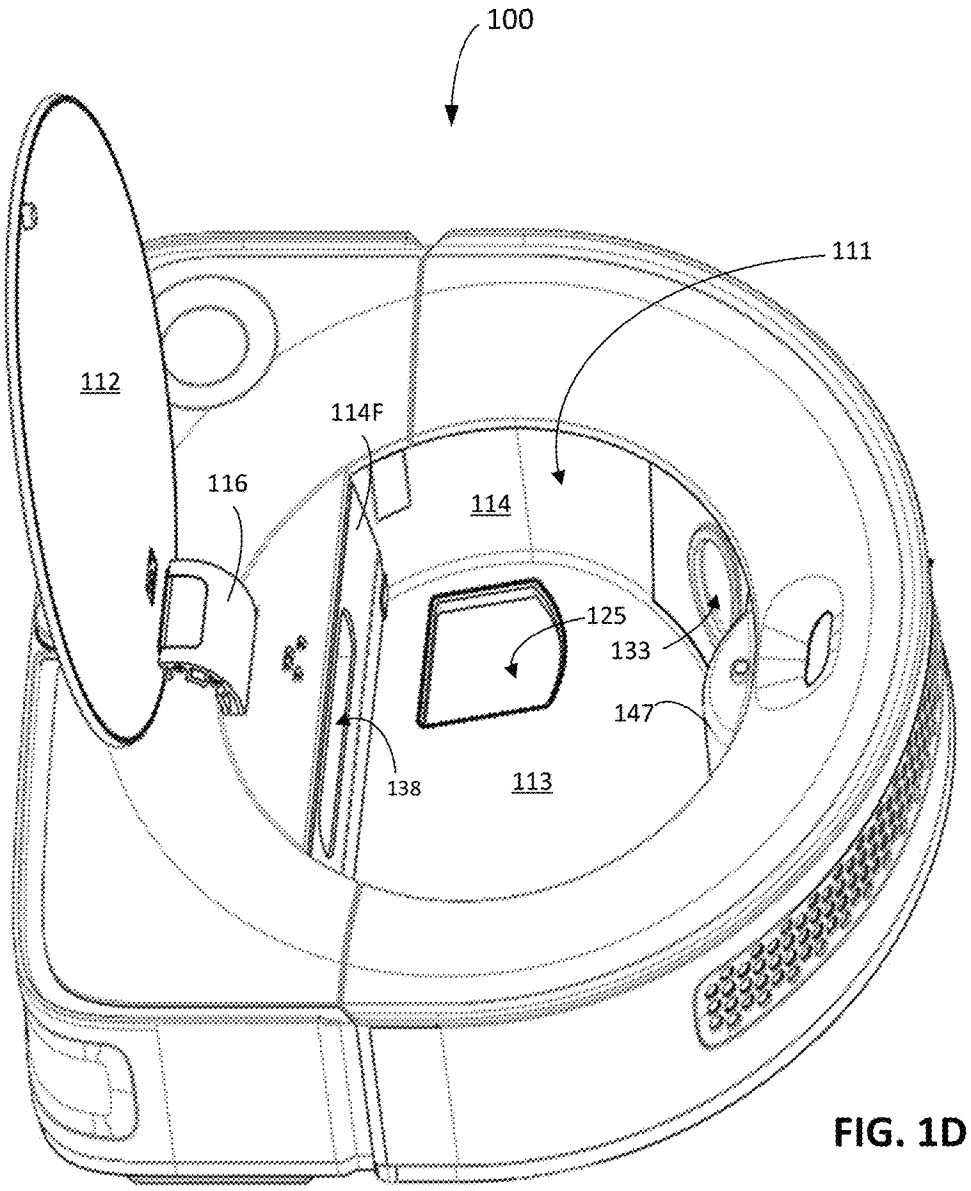
FIG. 1D is a top perspective view of an exemplary mobile cleaning robot with a debris bin removed.
Figure 1E:
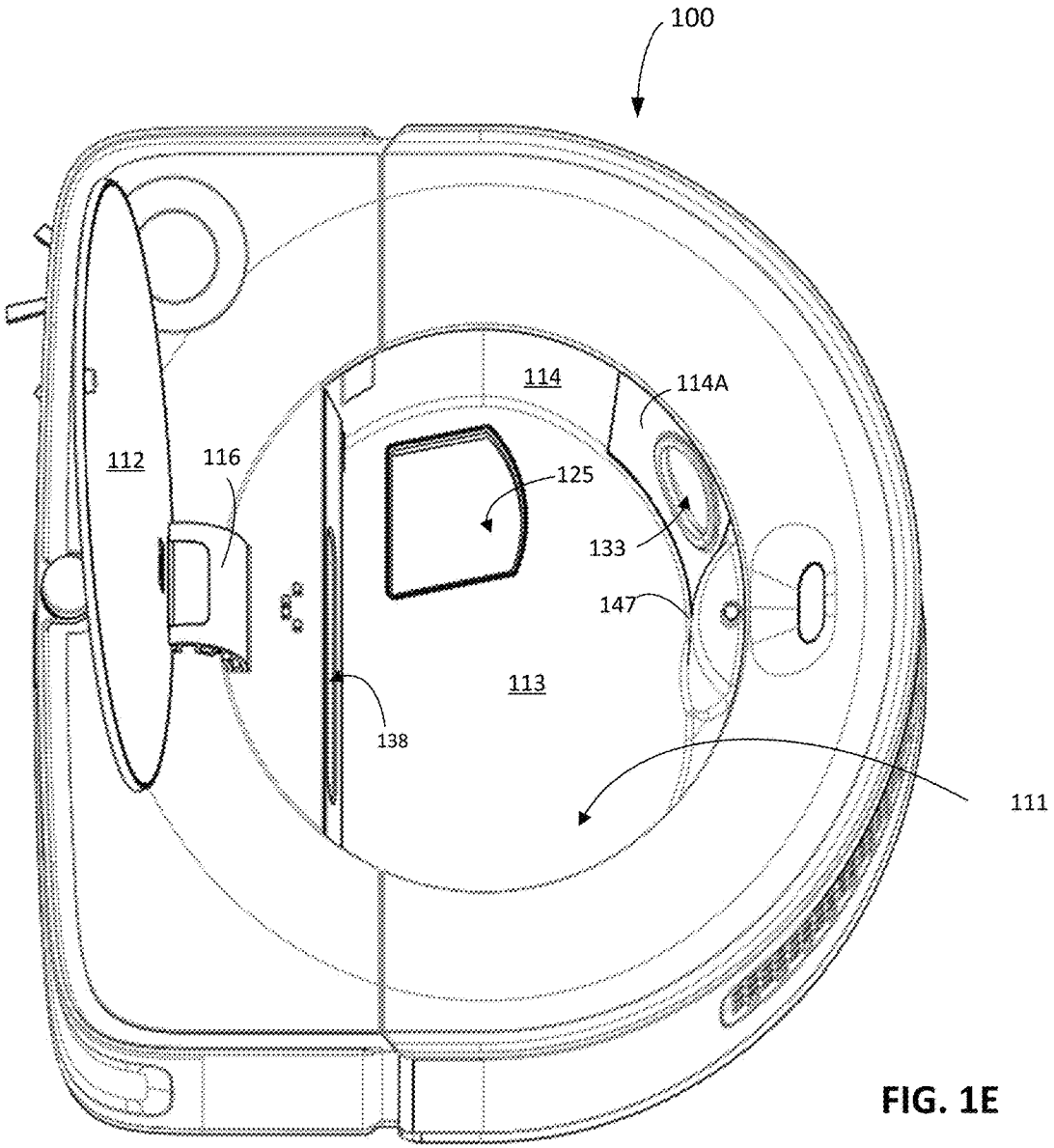
FIG. 1E is a top perspective view of an exemplary mobile cleaning robot with a debris bin removed.
Figure 2A:
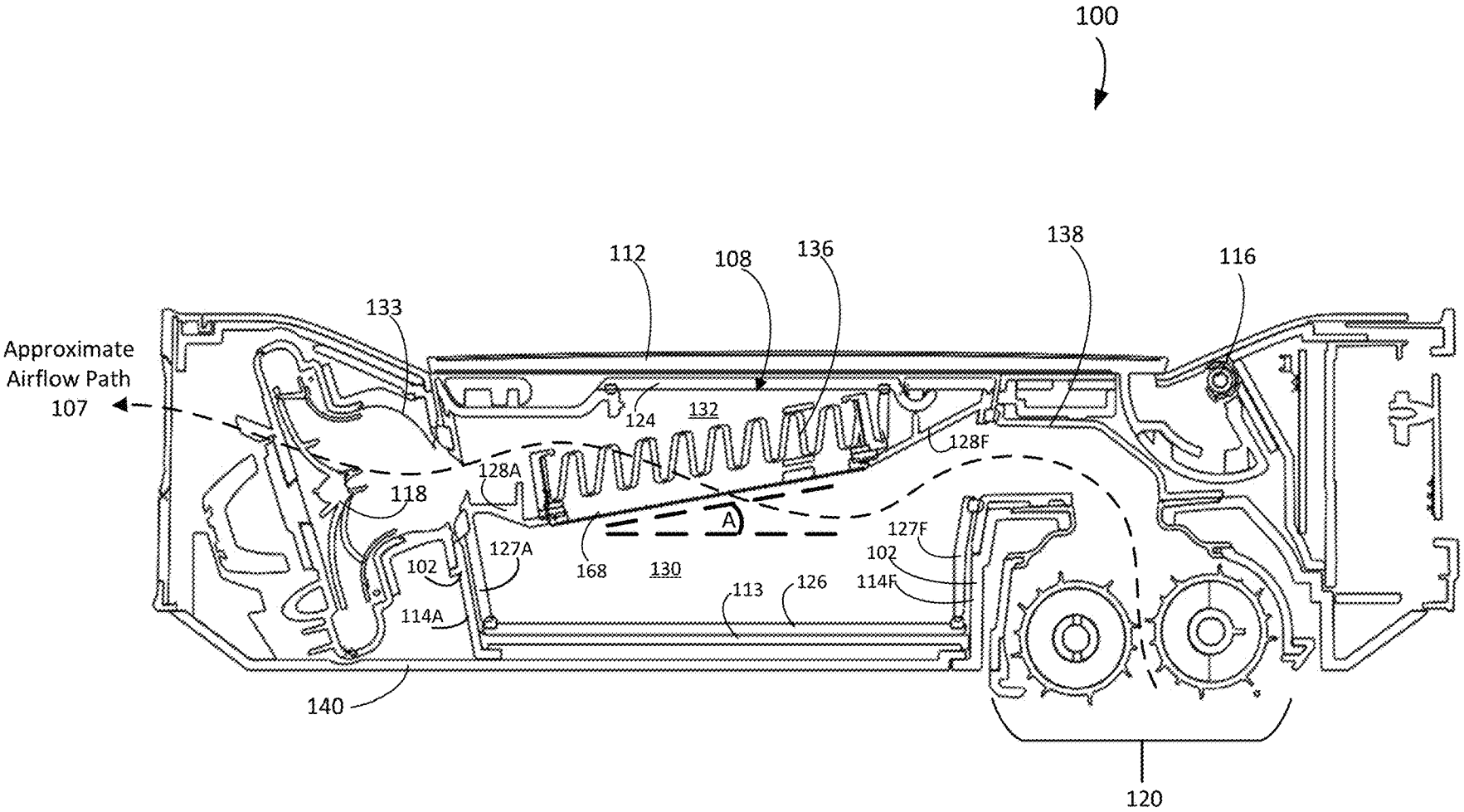
FIG. 2A is a schematic cross section side-view of the mobile cleaning robot showing a placement of a debris bin and an airflow path through the mobile cleaning robot.

Various components and/or assembly modules can be inserted and removed from the mobile cleaning robot 100 selectively for servicing. For example, the mobile cleaning robot 100 can receive a debris bin 108 for storing debris collected from the cleaning surface. As seen in FIGS. 1D, 1E and FIG. 2A, the mobile cleaning robot 100 includes a rigid support chassis 102 forming a seating 111 for receiving or otherwise supporting the debris bin 108. The seating 111 is a bin well in the mobile robot 100 for receiving the bin 108. The bin 108 can be inserted into and removed from the seating 111 selectively for servicing. The seating 111 includes one or more sidewalls 114 and a floor 113 that form a cavity in the chassis 102 for receiving the debris bin 108. The seating 111 may have one or more peripheral profiles for receiving a matching profile of the debris bin 108 in a unique orientation that ensures complete insertion of the bin and secure alignment of mating features between the debris bin 108 and the chassis 102. For example, the one or more peripheral profiles may be utilized to produce one or more keyed features 147 so that the bin 108 is received in a particular orientation. In some implementations, a sidewall 114 of the seating 111 is tilted from vertical to form a downward and inward taper from a surface of the mobile cleaning robot 100 to the floor 113 of the seating 111. For example, all or a portion of the sidewall 114 can be sloped to form a fully or partially funneled or conical shape. For example, in FIG. 1E, the aft portion of the sidewall 114A is sloped to taper inward at the end connecting to the floor 113 of the seating 113. The lower boundary of the seating 111 is defined by a floor 113 on which the debris bin 108 rests when the bin 108 is inserted into the seating 111. In some implementations, the sidewall 114 of the seating 111 includes a keyed feature 147 (e.g., a bump, indent, protrusion, etc.). The keyed feature 121 matches a complementary keyed feature of the bin 108. A sidewall (e.g., sidewall 127) of the debris bin 108 can be shaped to match the sidewall 114 of the seating 111, such as a slope of the downward and inward taper. In some implementations, one or more portions of the sidewall 114 can be flat or approximately flat to accommodate alignment of one or more entrance and evacuation ports of the debris bin 108 with the airflow path 107 of the mobile cleaning robot 100.

The shape of the seating 111 assists in properly inserting and orienting the debris bin 108 in the chassis 102. During insertion, the one or more keyed features 147 of the seating 111 can guide the bin 108 in for an appropriate positioning of the bin in the seating. a user may receive one or more types of feedback indicating a proper positioning of the debris bin 108. For example, such feedback can include audible feedback (e.g., a click, beep, or tap), tactile feedback (e.g., a physical sensation for the user such as sensing physical resistance, etc.), and/or visible feedback (e.g., a green light illuminates on a user interface of the mobile cleaning robot 100 and/or an associated application operating on a remote device communicating wirelessly with the mobile cleaning robot 100.

Returning to FIGS. 1A, 1B, 1D, 1E and 2A, the mobile cleaning robot 100 includes a bin access panel 112 that covers the seating 111, or receiving compartment, in the chassis 102. The bin access panel 112 encloses the debris bin 108 within the mobile cleaning robot 100 and prevents the debris bin 108 from being removed during a cleaning mission. As shown in FIGS. 1B and 2A, the bin access panel 112 is affixed to the chassis 102 by a panel hinge 116 (see FIG. 2A) such that the bin access panel 112 rotates open and closed over the seating 111. In some implementations, the bin access panel 112 closes over the bin 108 only when the debris bin 108 is seated in the chassis 102 with the debris bin 108 resting on the floor 113 of the seating 111. If the debris bin 108 is rotated or only partially inserted so that it is not fully inserted within the seating 111, the bin access panel 112 will not swing closed to cover the debris bin 108. In some implementations, a visual indication from the bin access panel 112 may alert a user that the debris bin 108 is not properly seated, thereby providing a visual prompt that corrective action is needed (e.g., adjust the alignment of the debris bin 108 for proper cleaning operations). In some implementations, the mobile cleaning robot 100 includes one or more mechanisms to prevent the mobile cleaning robot 100 from operating when the bin access panel 112 is ajar and/or if the bin access panel 112 is forced closed despite the debris bin 108 not being seated against the floor 113 of the seating 111. The mechanism can include one or more of a mechanical and/or electrical switch, electrical contact, sensor, and so forth for detecting that the bin access panel 112 is ajar.

FIG. 2A is a schematic side view cutaway of the mobile cleaning robot 100 showing a placement of the debris bin 108 within the mobile robot 100 and an airflow path 107 through the mobile robot 100 as indicated by a dashed line. The chassis 102 forms a structure for supporting one or more other components the mobile cleaning robot 100, such as a blower 118 (e.g., an impeller fan) for generating airflow within the mobile cleaning robot 100, the debris bin 108, and a cleaning head 120.

Figure 5:
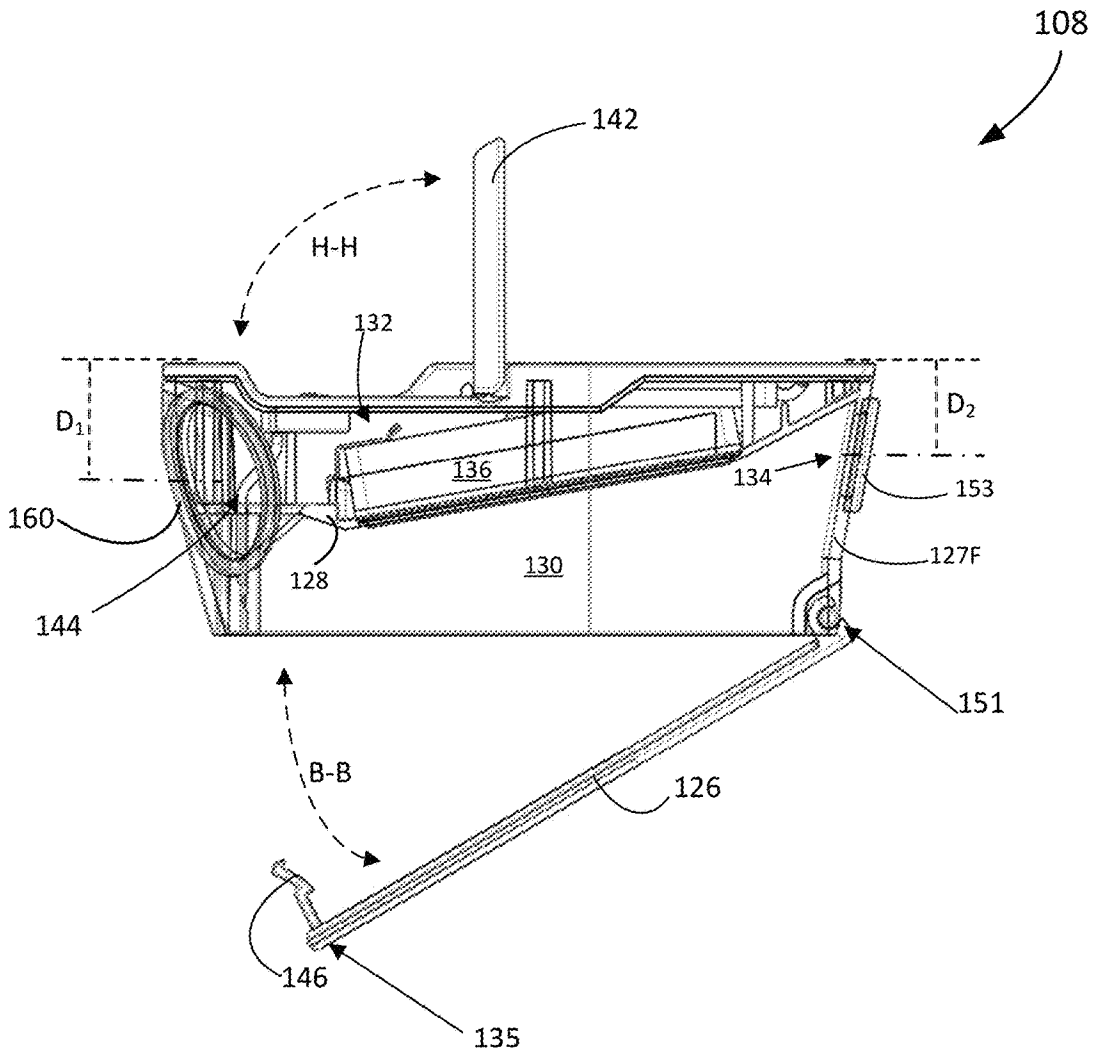
FIG. 5 is a transparent side-view of a n exemplary bin of the mobile robot showing movement of a handle and a bottom wall of the bin.

As depicted in FIGS. 2A and 5, the debris bin 108 of the mobile cleaning robot 100 includes an internal containment volume 130 for storing dust and debris collected by the mobile cleaning robot 100 during operation (e.g., cleaning operations). During operation, the debris bin 108 is disposed in the airflow path 107 of the mobile cleaning robot 100 and the blower 118 pulls air through the debris bin 108. The airflow path proceeds from the cleaning head 120 of the mobile cleaning robot 100 through a debris intake duct 138 and into the debris bin 108. The airflow path proceeds through a filter unit present in the debris bin 108, through the blower 118, and is then expelled from the mobile cleaning robot 100. The debris bin 108 receives debris carried by the airflow and pulled from a floor surface beneath the cleaning head 120 of the mobile cleaning robot. The debris bin 108 is removable from the mobile cleaning robot 100, for example, to be emptied of debris by a user, cleaned, and replaced.

The debris bin 108 includes a bin 108 that forms the structure of the bin and which is formed to fit in the seating 111 in the chassis 102 of the mobile cleaning robot 100. In some implementations, the bin 108 of the bin 108 is formed to fit in the seating 111 within a tolerance (e.g., 0-5 mm, 0-3 mm, and so forth). The tolerance ensures that the one or more ports of the debris bin 108 align with other features of the mobile cleaning robot 100 without adversely affecting airflow or allowing air leaks, as described below. One or more types of materials may be employed to for producing the bin 108, e.g., one or more rigid materials (e.g., a plastic). In some implementations, the rigid material includes a transparent portion for viewing the containment volume 130 of the debris bin 108, for example to determine if the bin 108 requires emptying. In some implementations, a debris-repelling material, such as a smooth plastic or an antistatic plastic, forms the bin 108 so that debris, such as dust, does not cling or stick to interior surfaces of the bin 108. In some implementations, one or more sensors placed within the debris bin 108 or at the opening of the debris bin 108 detect an approximate amount of debris in the debris bin 108 and send an alert to the mobile cleaning robot 100 that the bin 108 is in need of evacuation or emptying before proceeding with further operation (e.g., further vacuuming). The sensor can include an infrared sensor, an ultrasonic sensor, a ranging sensor, and so forth.

As depicted in FIGS. 2A, 3, 4, and 5, the bin 108 includes a top wall 124, a bottom wall 126, a sidewall 127, and an internal barrier 128 that together define an interior volume 130, 132 of the bin 108. The internal barrier 128 separates the internal containment volume 130, or a first volume 130, of the debris bin 108 from a second volume 132 of the debris bin 108. During operation, the first volume 130 of the debris bin 108 receives dust-laden air from the cleaning head 120 though an intake port 134 (e.g., an aperture) in the sidewall 127 of the first volume 130 and expels air through the filter unit 136. During operation, the second volume 132 of the bin 108 receives filtered air from the first volume 130 through the filter unit 136 of the bin 108 and expels air through the exhaust port 144. In some implementations, the exhaust port 144 is adjacent the blower 118. The blower 118 sucks in air through the exhaust port 144 and expels the air from the mobile cleaning robot 100, through a vent 220 (FIG. 9) in the aft portion 106 of the external body of the mobile cleaning robot 100.

The first volume 130 stores the debris collected by the cleaning head 120 of the mobile cleaning robot 100, such as dust or debris lifted from a cleaning surface on which the mobile cleaning robot 100 travels. The first volume 130 receives debris-laden airflow. A forward portion 127F of the sidewall 127, the bottom wall 126 of the bin 108, and the internal barrier 128 define the first volume 130. The forward portion 127F of the sidewall 127 includes the intake port 134 of the bin 108. The intake port 134 is an aperture in the forward portion 127F of the sidewall 127 that receives and directs airflow from the cleaning head 120 into the first volume 130. When the debris bin 108 is seated in the seating 111 of the chassis 102, the intake port 134 aligns with a debris intake duct 138 (FIG. 2A) of the cleaning head 120.

Figure 6A:
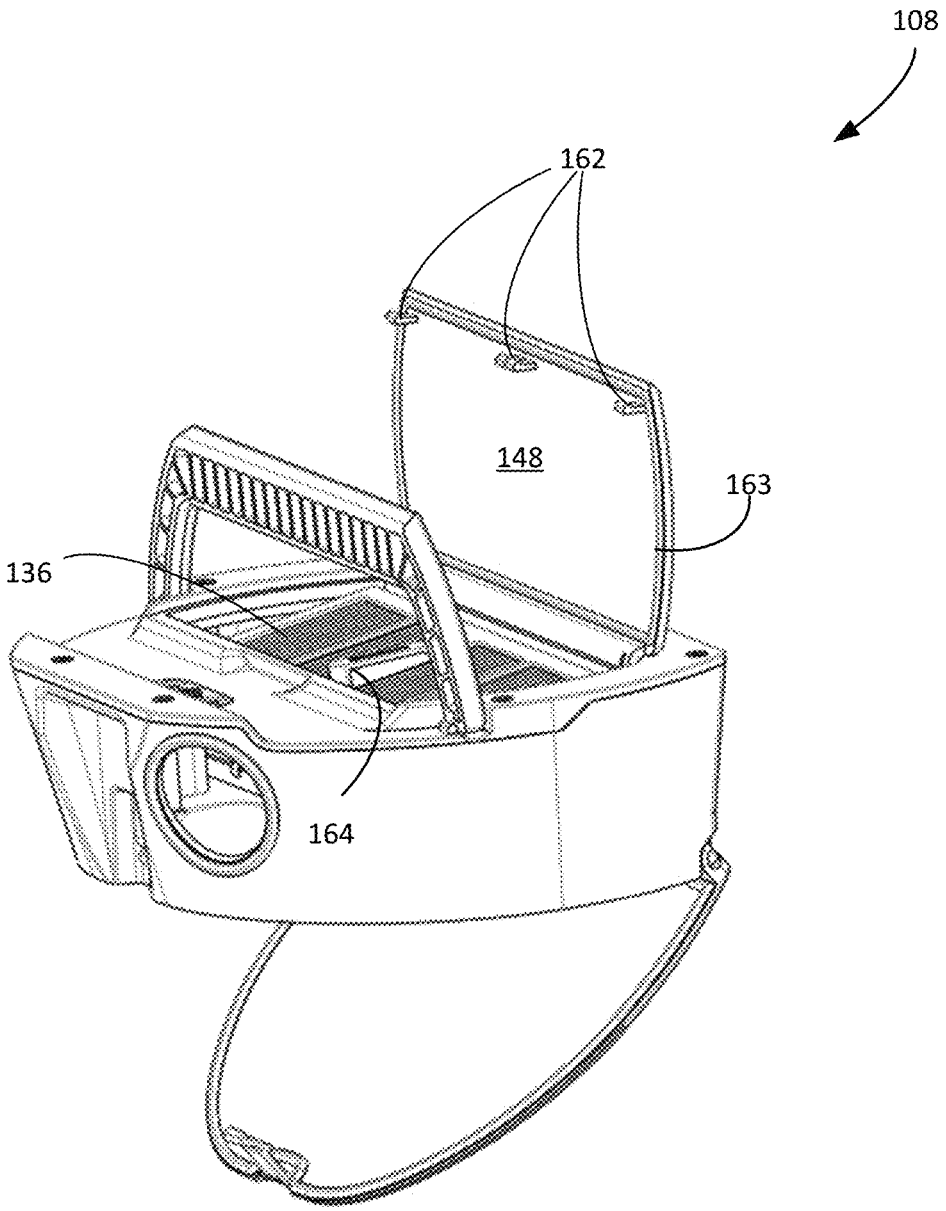
FIG. 6A shows a perspective view of an exemplary bin of the mobile robot including a filter unit inside the bin.
Figure 6B:
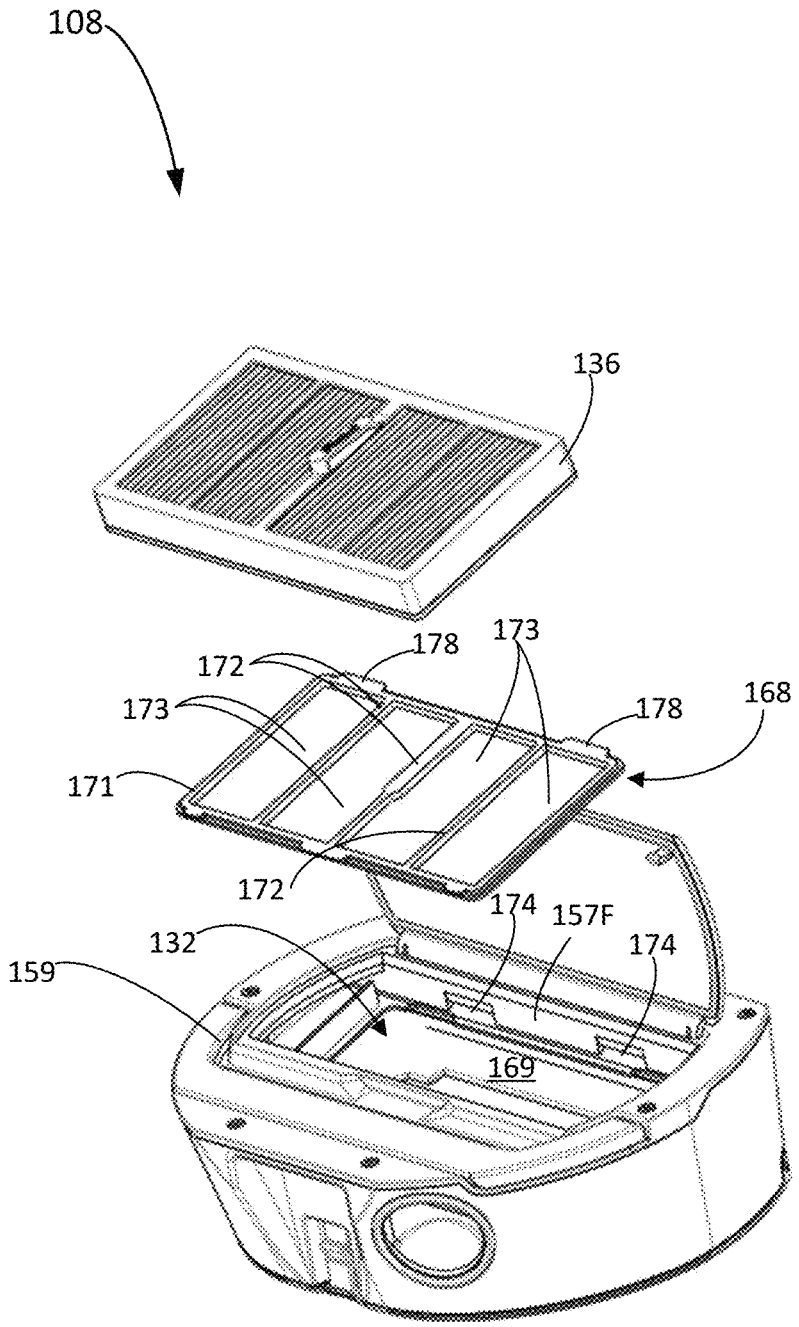
FIG. 6B is an exploded perspective view of the exemplary bin and filter unit of FIG. 6A.
Figure 6C:
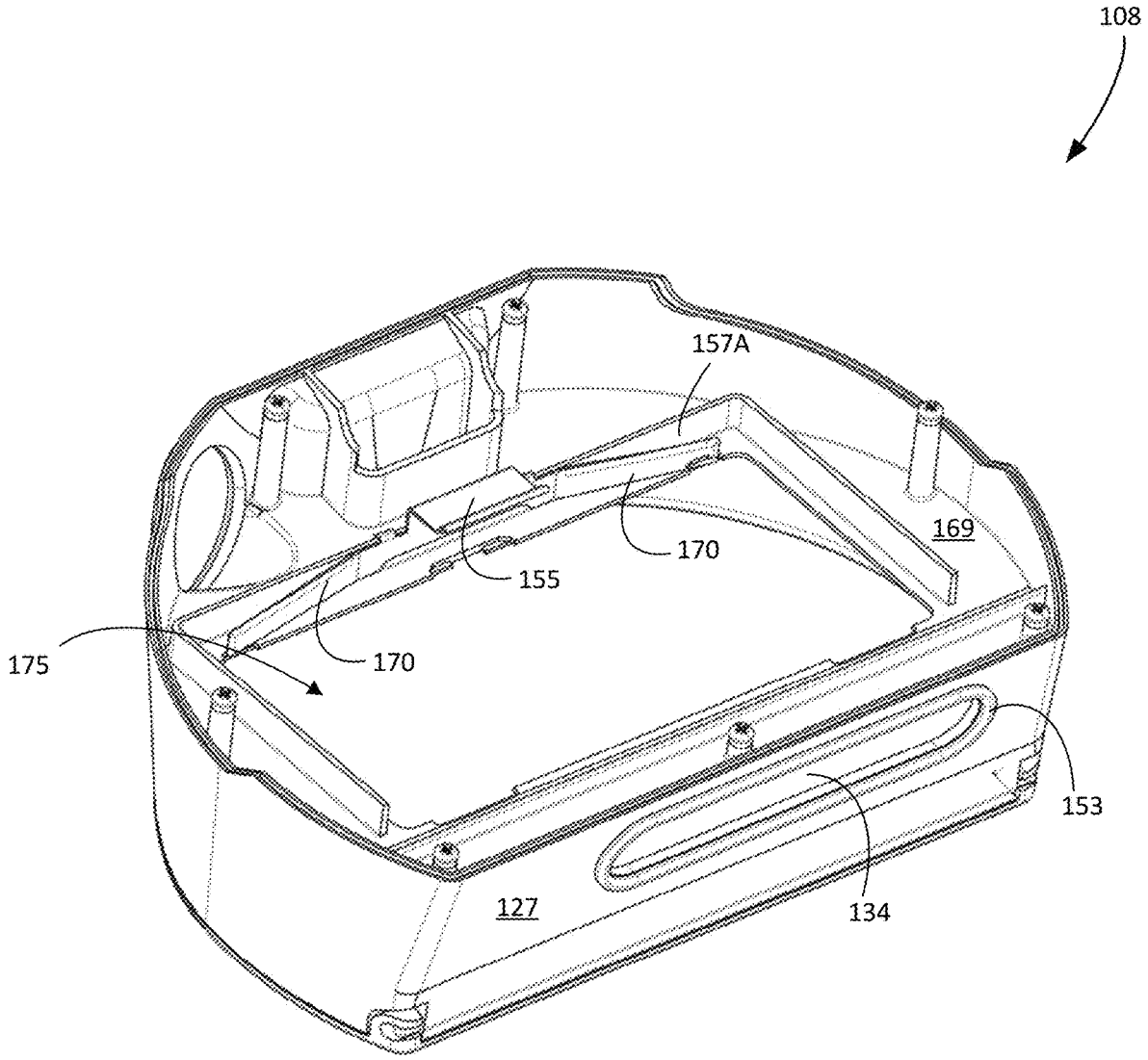
FIG. 6C is a top perspective view of the exemplary bin of FIG. 6A with the filter unit removed.

In implementations, as shown in FIG. 6C, a smooth shape of the intake port 134 has no edges or corners entrapping debris when entering the bin 108. In some implementations, the intake port 134 includes an elongated, pseudo-elliptical aperture that matches an abutting aperture of the debris intake duct 138 of the cleaning head 120. In some implementations, the edge of the intake port 134 includes a pliable lip 153 that forms an intake port seal for sealing the intake port with the duct 138 of the cleaning head 120 when the bin 108 is disposed in the seating 111 and the intake port 134 is aligned with the debris intake duct 138. In some implementations, the intake port 134 is located nearer the top wall 124 of the bin 108 of the bin 108 rather than the bottom wall 126. When the bin 108 fills with debris during operation, the position of the intake port 134 is such that the intake port 134 is not clogged with debris until the bin is approximately full of debris and needs to be emptied. In some implementations, the position of the intake port 134 allows air to be pulled across the first volume 130 by the blower 118 and through the filter without a winding path through debris. This configuration enables unimpeded airflow so that the full velocity of airflow from the blower 118 reaches the cleaning head.

Returning to FIGS. 2A and 5, the second volume 132 stores the filter unit 136 and receives air that has been filtered of dust and debris by the filter unit 136. Together, an aft portion 127A of the sidewall 127 of the bin 108, the top wall 124, and the internal barrier 128 define the second volume 132. The aft portion 127A of the sidewall 127 that defines the second volume 132 includes the exhaust port 144.

The exhaust port 144 of the bin 108 is an aperture in the aft portion 127F of the sidewall 127 that channels airflow 107 from the second volume 132 to the blower 118 of the mobile cleaning robot 100. When the bin 108 is seated the seating 111 of the chassis 102, the exhaust port 144 aligns with an intake duct 133 of the blower 118. In some implementations, an exhaust port seal 160 is a pliable lip around the opening of the exhaust port 144 that forms a seal with an intake duct of the blower 118 when the bin 108 is seated in the chassis 102 and the exhaust port is aligned with the blower intake duct 133. In some implementations, the exhaust port 144 is located nearer the top wall 124 bin 108 than the bottom wall 126 of the bin 108. The exhaust port 144 is located nearer the top wall 124 of the bin 108 to allow a size of the first volume 130 to be relatively larger than if the exhaust port 144 were located near the bottom wall 126 of the bin 108. Such a configuration increases the amount of debris that the bin 108 can carry relative to a bin 108 having a placement of the exhaust port near the bottom wall 126 of the bin 108.

The internal barrier 128 separates the first volume 130 of the bin 108 from the second volume 132 of the bin 108. The internal barrier 128 supports the filter unit 136 inside the bin 108. The internal barrier prevents debris from entering the second volume 132 of the bin 108 from the first volume 130.

In implementations, the filter unit 136 is supported on a ledge around the internal barrier. In other implementations, the filter unit 136 is disposed on support beams or struts 172 extending across the aperture 175 in the internal barrier 128. In implementations, such as that shown in FIGS. 6B and 6F, the support beams or struts 172 are part of a prefilter, or pre-screen, frame 171. The air pulled through the airflow path 107 passes through gaps between the support beams 172 and through the filter unit 136 disposed thereon. In some implementations, at least a portion of the internal barrier 128 is disposed at an angle (e.g., the angle marked "A" on FIG. 2A) inside the bin 108. The angle is relative to the bottom wall 126 of the bin 108. For example, a forward portion 128F of the internal barrier 128 is closer to the top wall 124 of the bin 108 than the bottom wall 126 and an aft portion 128A of the internal barrier 128 is further from the top than the forward portion 128F of the internal barrier 128. The angle A of the internal barrier 128 supporting the filter unit 136 tilts the filter unit for uniform airflow across the surface of the filter unit 136 facing the intake port 134.

Figure 6D:
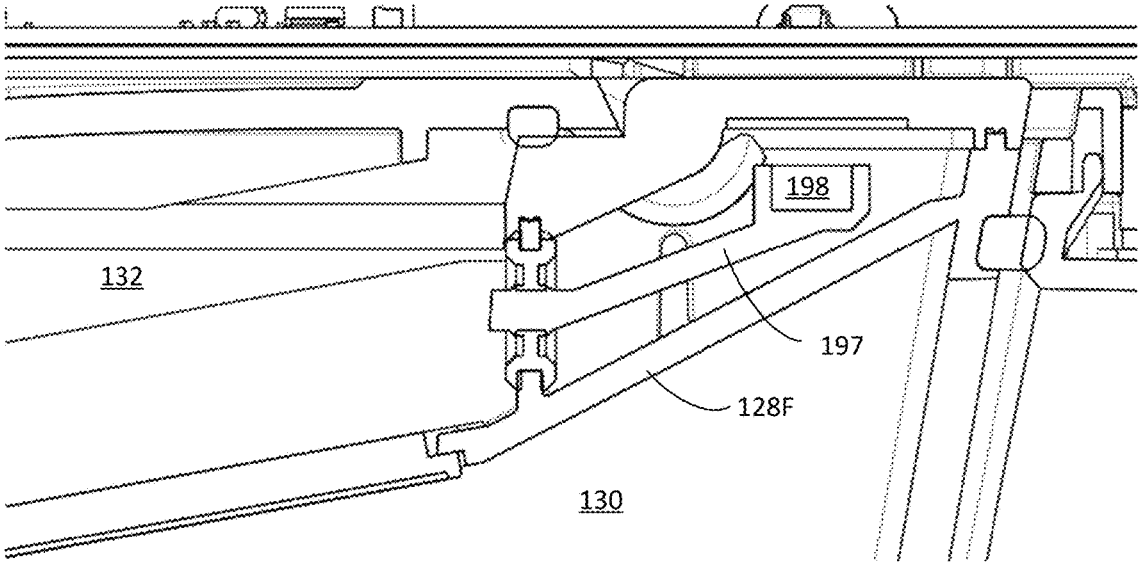
FIGS. 6D and 6E are side cross section views of an exemplary bin showing a filter presence sensor.
Figure 6E:
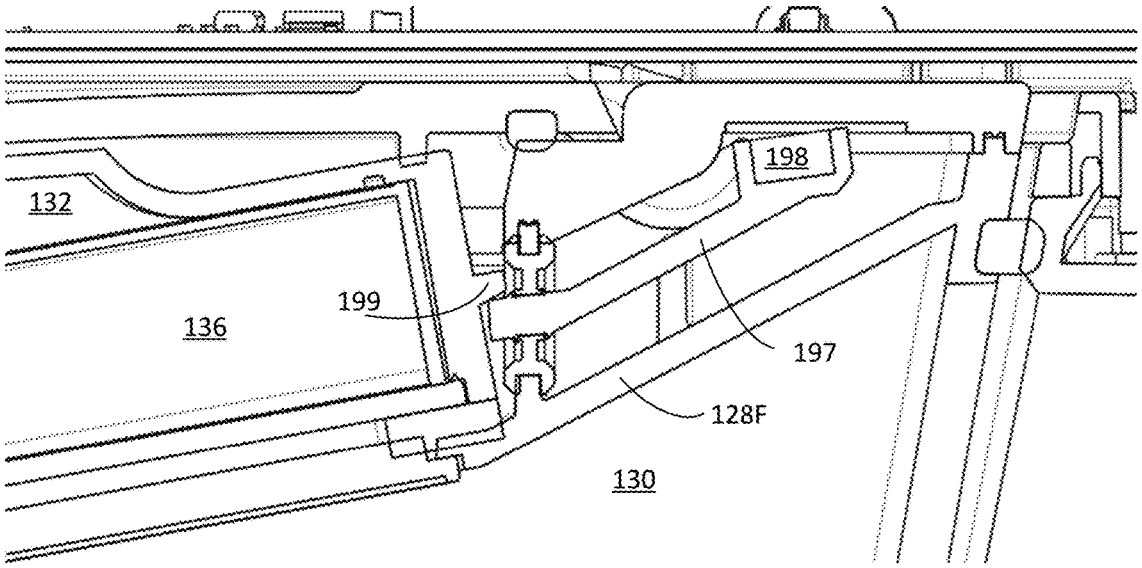

In implementations, the bin 108 includes a filter presence sensing assembly including a lever arm 197 having a magnet 198 on one end and a rubber grommet 300 sealing where the lever arm 197 passes through to the second volume 132. As shown in FIG. 6D, when the filter unit 136 is not present, the magnet 198 is in a low position away from a hall sensor in the bin access panel 112. As shown in FIG. 6E, when the filter unit 136 is installed, a tab 199 on the filter unit 136 pushes down on the lever arm 197 and lifts the magnet 198 towards the hall sensor, which in turn senses the presence of the filter unit 136. The presence sensor assembly therefore provides a failsafe against the robot operating without the filter unit 136 installed.

The airflow path is defined by the components of the mobile cleaning robot 100. The airflow path includes a path for airflow into and though the cleaning head 120, the debris intake duct 138, the intake port 134, the bin 108, the exhaust port 144, the blower 118, and out the vent 220 in the mobile cleaning robot 100. The blower 118 pulls air through the cleaning head 120 and the bin 108 to create a negative pressure (e.g., vacuum pressure effect) on a cleaning surface that is proximate to the cleaning head 120. In some implementations, the airflow path 107 is a pneumatic airflow path. The airflow of the airflow path 107 carries debris and dirt into the debris bin 108 from the cleaning surface. The air is cleaned by the filter unit 136 disposed in the bin 108, through which the airflow path 107 proceeds during operation of the mobile cleaning robot 100. Clean air is expelled from the vent 220 of the mobile cleaning robot 100.

The configuration of the internal barrier 128, the intake port 134, and the exhaust port 144 in relation to one another directs the airflow path 107 though the bin 108. As shown in FIG. 5, in some implementations, the intake port 134 and the exhaust port 144 are approximately the same vertical distance (shown as distances $D_1$, $D_2$) from the top wall 124 of the bin 108. In some implementations, the intake port 134 and exhaust port are on either side of a centerline that divides the bin 108 along an axis B extending from a forward portion 141 of the bin 108 to an aft portion 143 of the bin, as explained below in relation to FIG. 8. As shown in FIG. 2A, the airflow path 107 inside the bin 108 progresses from the intake port 134 through the filter unit 136 disposed in the internal barrier 128 to the exhaust port 144. The airflow path 107 crosses the internal barrier 128 through the filter unit 136. By positioning the intake port 134 and the exhaust port 144 on either side of the centerline, the airflow path 107 crosses the bin 108 laterally as well as longitudinally.

Returning to FIG. 5, the shape of the first volume 130 determines how the first volume 130 fills with debris during operation. In some implementations, the shape of the first volume 130, defined partly by the internal barrier 128, causes the first volume 130 to backfill with debris during operation of the mobile cleaning robot 100. The airflow carries debris into the first volume 130 of the bin 108 through the intake port 134. As the air is sucked through the filter unit 136 into the second volume 132, the debris inside the first volume 130 does not pass through the internal barrier 128. In some implementations, the internal barrier 128 pushes lighter, airborne debris toward the bottom wall 126 of the bin 108 and away from the filter unit 136 as more air flows in through the intake port 134 and through the filter unit 136. bin 108

Figure 2B:
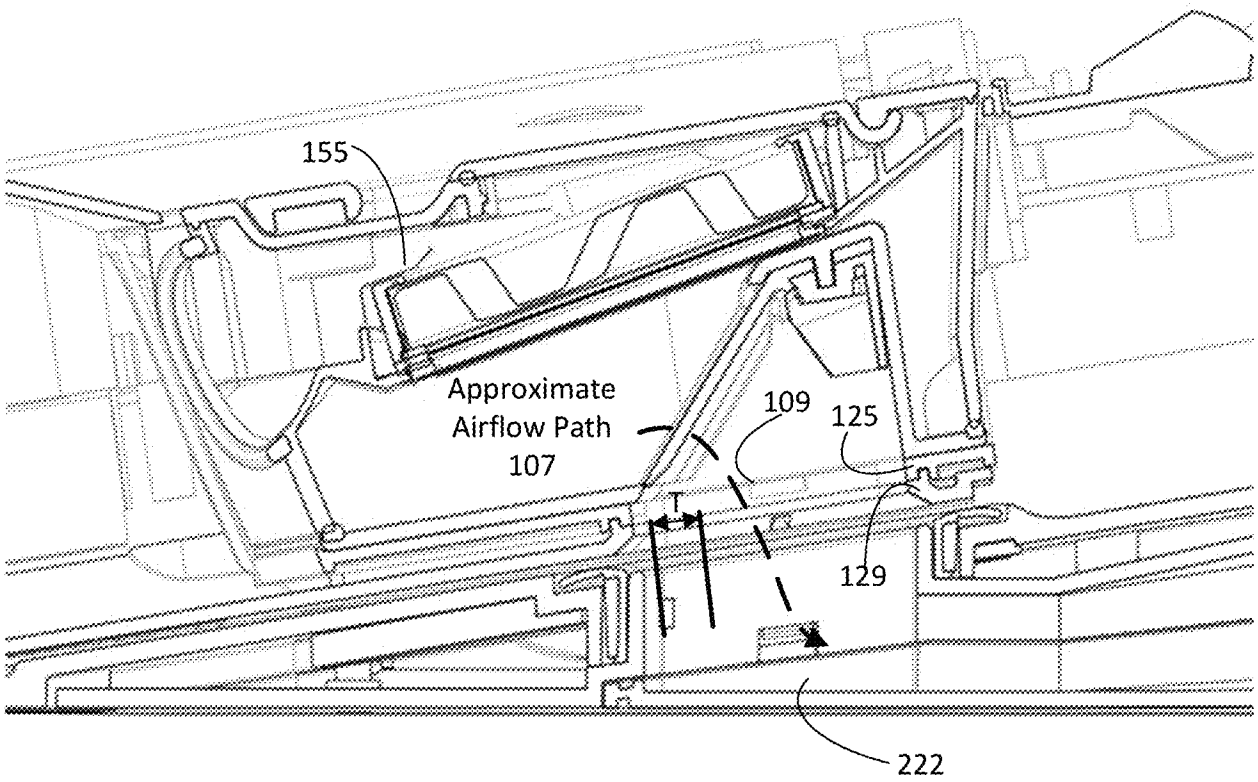
FIG. 2B is a schematic cross section side-view of the mobile cleaning robot showing the alignment of an evacuation port, seating aperture, and bottom surface aperture for bin evacuation.
Figure 2C:
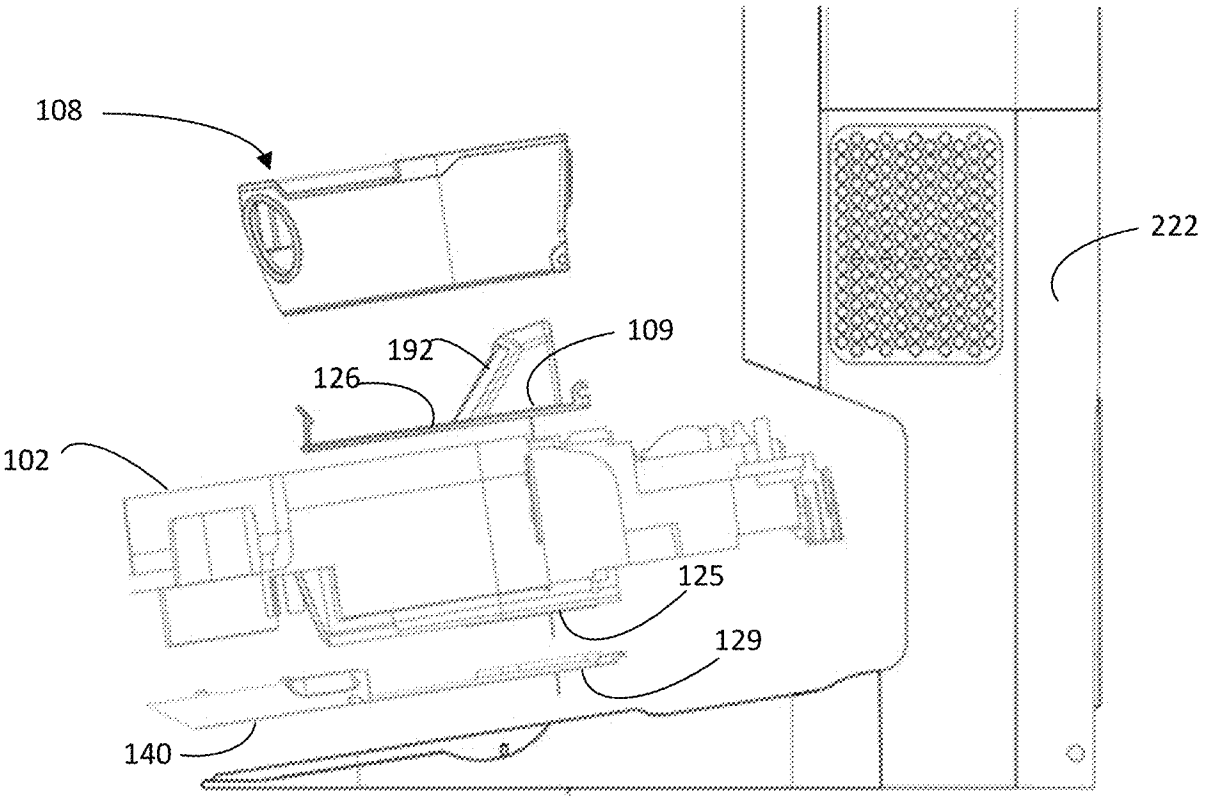
FIG. 2C is an exploded side-view showing the alignment of portions of the mobile cleaning robot for evacuation at an evacuation station.

One or more bin sensors, such as optical sensors, can be used to measure approximately how much debris is accumulating in the first volume 130, and when the first volume 130 is full of debris and should be emptied. A signal can be sent from the bin full sensor indicating this measurement to a controller or processor of the mobile cleaning robot 100. In some implementations, the controller or processor can generate instructions to cease cleaning operations and cause the mobile cleaning robot 100 to navigate to an external evacuation device 222 (FIGS. 2B and 2C). In some implementations, the controller can generate a measurement on a graphical user interface of the mobile cleaning robot 100 or an associated remote device in communication with the mobile cleaning robot 100, send an alert to a remote device, cause a beacon to light, or otherwise indicate to a user that the bin 108 of the mobile cleaning robot 100 should be emptied. In some implementations, a bin presence sensor is mounted inside the seating 111. The bin presence sensor can determine whether the debris bin 108 is present inside the mobile cleaning robot 100. If the debris bin 108 is not present during the cleaning operation, the controller of the mobile cleaning robot 100 can will prevent the mobile cleaning robot 100 from operating and send a signal indicating that the bin 108 should be inserted into the seating 111 before the cleaning operation continues. In some implementations, the bin full sensor and the bin presence sensor are distinct sensors.

The airflow path through the debris bin 108 continues through the filter unit 136 from the first volume 130 into the second volume 132. The air is filtered by the filter unit such that the air is free or approximately free of debris, dust, and other particulate matter before being expelled through the vent 220 in the mobile cleaning robot 100 by the blower 118. In some implementations, the filter unit 136 is removably disposed in the airflow path 107. The filter unit 136 can be removed and cleaned of dust or debris or replaced with a new filter unit 136. More detail relating to the placement and operation of the filter unit 136 is described in relation to FIGS. 6A-6B, below.

Figure 9:
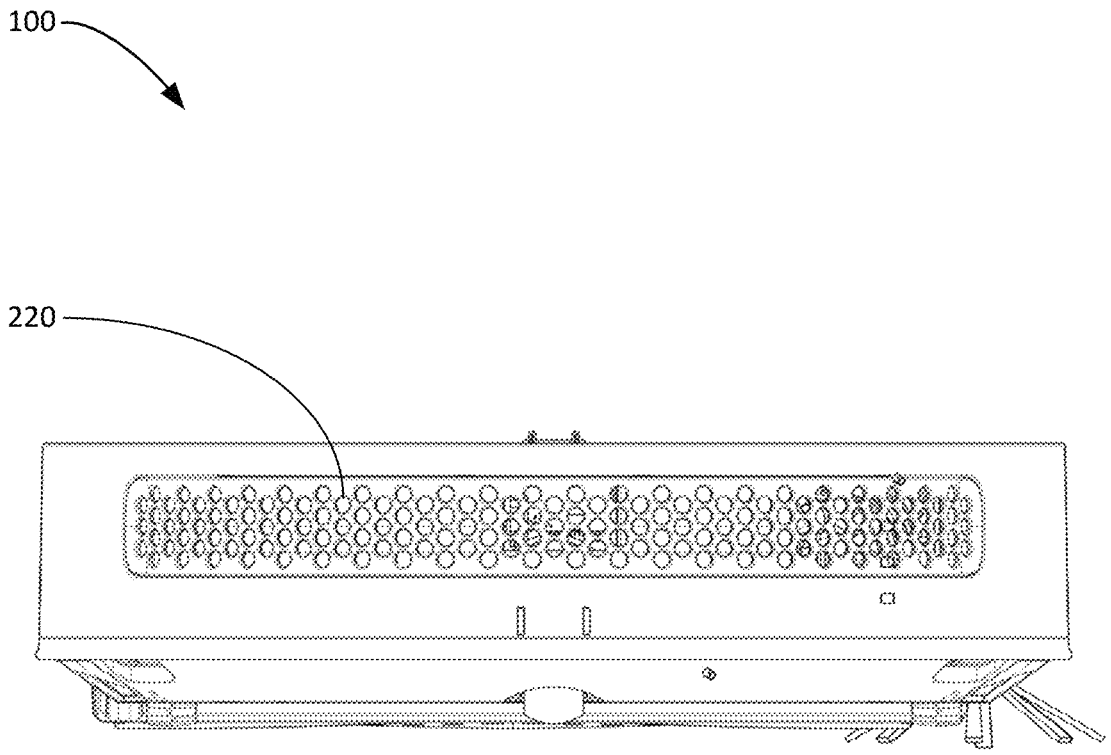
FIG. 9 is an exemplary rear view of the mobile cleaning robot of FIG. 1.

FIG. 9 shows a rear view of the mobile cleaning robot including a vent 220. The airflow path terminates by passing through the blower 108 and out the vent 220 in the rear of the robot.

FIG. 2A further shows the debris bin 108 as fully seated in the chassis 102. The bin access panel 112 covers the debris bin 108 when the debris bin 108 is seated in the chassis 102. In some implementations, when the bin access panel 112 is ajar or when the debris bin 108 is not present in the seating 111, the mobile cleaning robot 100 will not perform cleaning operations (e.g., autonomous vacuuming). The bin access panel 112 includes a panel hinge 116 for attaching the bin access panel 112 to the chassis 102 of the mobile cleaning robot 100. The bin access panel 112 can be closed when the debris bin 108 is properly seated or when the debris bin 108 is not present in the seating 111. The bin access panel 112 is not closeable when the debris bin 108 is improperly seated in the chassis 102.

The proper positioning of the debris bin 108 can include alignment of one or more ports on the bin 108 (e.g., an intake port 134, an evacuation port 109, an exhaust port 144, and so forth) with one or more features of the mobile cleaning robot 100. In some implementations, when the bin 108 is properly positioned in the mobile cleaning robot 100, the intake port 134 aligns with the debris intake duct 138 mated to the cleaning head 120. Preferably, the alignment of the intake port 134 is within a one millimeter tolerance of an opening of the debris intake duct 138. Preferably, the alignment of the exhaust port 144 is within a one millimeter tolerance of the blower intake duct 133. In some implementations, the alignments of each of the intake port 134 and the exhaust port 144 with their respective ducts 138, 133 are within three millimeters of tolerance. In some implementations, the alignments of each of the intake port 134 and the exhaust port 144 with their respective ducts 138, 133 are within five millimeters of tolerance. Alignment of each of the intake port 134 and the exhaust port of the bin 108 completes the airflow path 107 through the mobile cleaning robot 100. The airflow path 107 extends from the cleaning head 120, into the intake port 134 of the bin 108, through the bin 108, and out the exhaust port 144 and through the blower 118.

Figure 8:
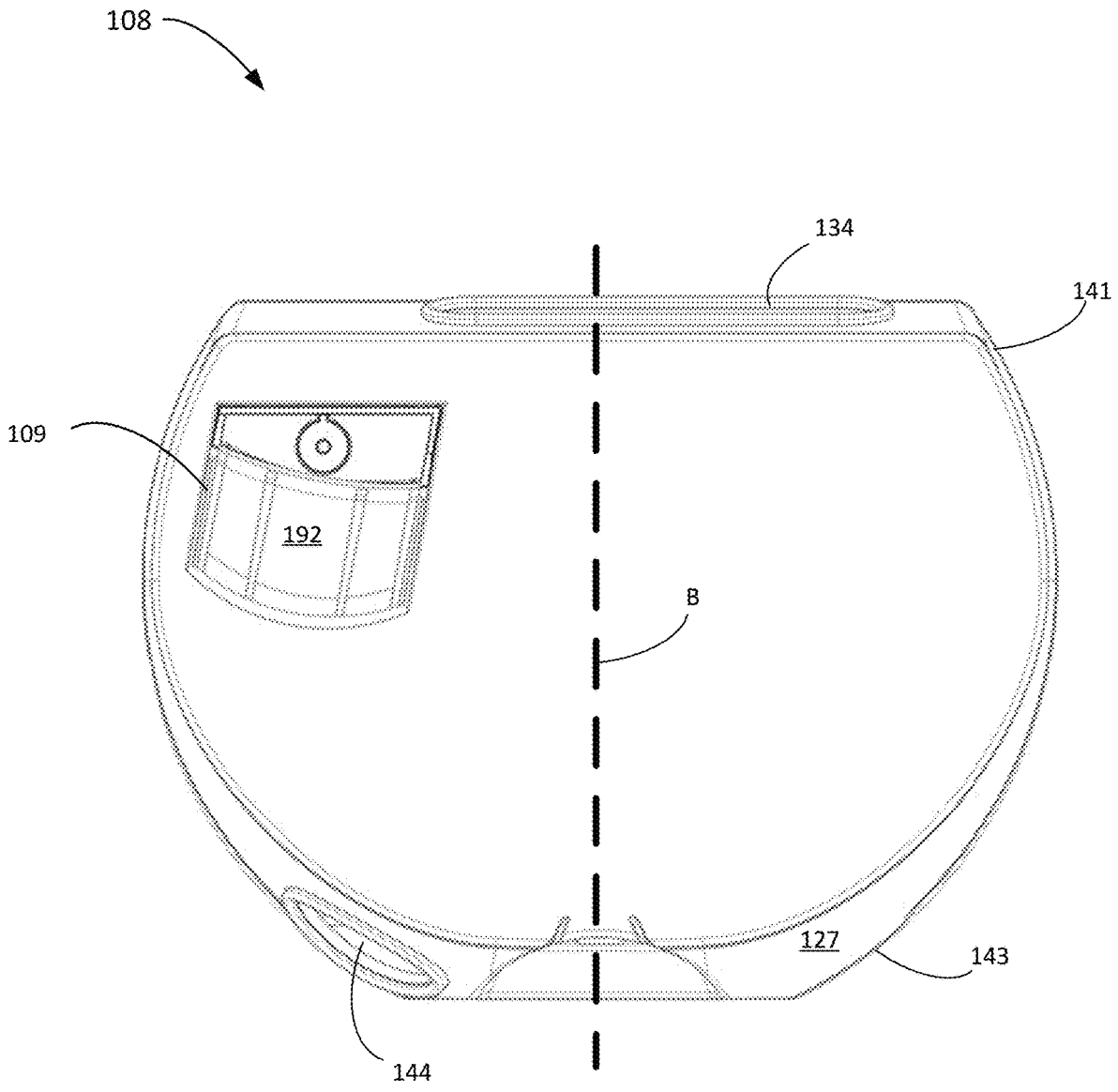
FIG. 8 is a bottom view of an exemplary bin of the mobile robot.

Turning to FIG. 8, the debris bin 108 includes an intake port 134 and an exhaust port 144. An axis labeled "B" is shown along a forward-aft centerline of the debris bin 108. The intake port 134 is disposed on the sidewall 127 of the debris bin 108 in alignment with the first volume 130 of a bin 108. The exhaust port 144 is disposed on the sidewall 127 of the debris bin 108 in alignment with the second volume 132 of the bin 108. The first volume 130 and the second volume 132 of the bin 108 are separated by the internal barrier 128 (not shown). The centerline divides the bin 108 along centerline axis B. A lateral center C of the intake port 134 is shifted toward a first side of the centerline axis B and the exhaust port 144 is on the opposite side of the centerline axis B. As the airflow path 107 proceeds from the intake port 134, through a filter unit 136 of the internal barrier 128, and out the exhaust port 144, the airflow path 107 crosses the centerline axis B of the bin 108 allowing debris to fall across the entire debris bin 108 instead of passing through only a portion of the first volume 130 and accumulating in a single location.

Referring to FIGS. 8, 2B, and 2C, in some implementations, the bin 108 includes an evacuation port 109. The evacuation port 109 is an additional port in the bottom wall 126 of the bin 108 that remains closed during some operations, such as cleaning operations, but can open for other operations, such as bin 108 evacuation operations. In some implementations, the seating 111 includes a seating aperture 125 (shown in FIGS. 1D and 1E) in the floor 113 of the seating (e.g., in the chassis 102). When the bin 108 is properly seated in the chassis 102, the evacuation port 109 of the bin 108 aligns with the seating aperture 125. Preferably, the alignment of the evacuation aperture 109 is within a one millimeter tolerance of the seating aperture 125. In some implementations, the alignment of the evacuation port 109 with the seating aperture 125 of the seating 111 is within three millimeters. In some implementations, the alignment of the evacuation port 109 with the evacuation aperture 109 of the chassis 102 is within five millimeters.

The mobile cleaning robot 100 includes a bottom surface 140 that, in some implementations, includes a bottom surface aperture 129. The bottom surface aperture 129 aligns with the seating aperture 125, which is in alignment with the evacuation port 109 of the bin 108 to form an open passage from the bin 108 inside the mobile cleaning robot 100 to the exterior of the mobile cleaning robot 100. The open passage enables evacuation of the bin 108 while the bin is seated inside the mobile cleaning robot 100, such as by an external evacuation mechanism, as described below in relation to FIGS. 2B-2C. Preferably, the evacuation port 109, the seating aperture 125, and the bottom surface aperture 129 all align within a one millimeter tolerance. In some implementations, the evacuation port 109, the seating aperture 125, and the bottom surface aperture 129 all align within a three millimeter tolerance. In some implementations, the evacuation port 109, the seating aperture 125, and the bottom surface aperture 129 all align within a five millimeter tolerance.

The alignment of the evacuation port 109, the seating aperture 125, and the bottom surface aperture 129 is shown in FIGS. 2B-2C. The alignment creates an open passage in the mobile cleaning robot 100 and increases airflow during evacuation relative to a misaligned passage. The evacuation airflow is proportional to a cross-sectional dimension of the open passage. The airflow would be reduced, and debris would be blocked in the passage, due to a misalignment of the evacuation port 109, the seating aperture 125, and the bottom surface aperture 129. As such, alignment of the open passage provides for a faster, more effective evacuation of the debris from the bin 108. The alignment of the evacuation port 109, the seating aperture 125, and the bottom surface aperture 129 is within tolerance "T" as shown in FIG. 2B. In some implementations, the distance shown by "T" is less than one millimeter. In some implementations, the distance "T" is less than 3 millimeters. In some implementations, the distance "T" is between 3 and 5 millimeters.

Evacuation can occur autonomously from an external evacuation station 222, shown in FIG. 2C. When the mobile cleaning robot 100 determines that evacuation of the debris bin 108 is needed (e.g., the bin 108 is full), the mobile cleaning robot 100 navigates to the evacuation station 222. In some implementations, the evacuation station 222 can be integrated with a docking, or charging, station of the mobile cleaning robot 100. For example, evacuation can occur during a recharge of a power system of mobile cleaning robot 100. FIG. 2C shows an exploded view of the alignment of the debris bin 108, bottom wall 126, bottom surface 140, chassis 102, seating aperture 125, and bottom surface aperture 129. When the mobile cleaning robot 100 navigates to the external evacuation station 222, the evacuation port 109 aligns with a suction mechanism of the external evacuation station, and the debris inside the bin 108 is sucked from the bin 108 through the evacuation port 109.

In some implementations, a breakaway segment covers the bottom surface aperture of the bottom surface 140. The breakaway segment can include a perforation in the bottom surface 140 of the mobile cleaning robot 100. A user can choose to remove the breakaway segment for autonomous evacuation operations.

Returning to FIG. 8, an evacuation port 109 includes a movable barrier 192. The movable barrier 192 selectively seals and opens enabling evacuation of the contents of the bin 108. The moveable barrier 192 can include a rigid material in some examples and a compressible material in other examples. In some implementations, the movable barrier 192 includes a valve that can be pulled open when a negative pressure (e.g., a suction force) is applied to the exterior of the bin 108 at the position of the movable barrier 192. In some implementations, the mobile cleaning robot 100 detects that the bin 108 is full of debris and needs to be evacuated. The mobile cleaning robot 100 enters an external evacuation station 222 that includes a mechanism for applying a suction force on the moveable barrier 192. The bottom surface 140 of the mobile cleaning robot 100 and the seating 111 of the chassis 102 each have apertures 125, 129 to create an open passage (e.g., as seen in FIGS. 1D, 1E, and 2B). The apertures 125, 129 of the chassis 102 and the bottom cover are aligned when the bin 108 is properly seated in the seating 111 of the chassis 102 as described above in relation to FIGS. 2A and 1D-1E.

In implementations, the movable barrier 192 is a flap that moves between an open position and a closed position in response to a difference in air pressure at the evacuation port 109 and within the debris bin 108. The evacuation station 222 can generate a negative air pressure causing the air in the debris bin 108 to generate an air pressure that moves the flap 192 from the closed position to the open position. In the closed position, the flap 192 blocks air flow between the debris bin and the environment. In the open position, a path is formed in the open passage through the flap 192 between the debris bin 108 and the evacuation port 109.

The bottom wall 126 of the bin 108 can include a biasing mechanism that biases the movable barrier 192 into the closed position. In some implementations, a torsion spring biases the movable barrier 192 into the closed position. The movable barrier 192 rotates about a hinge having a rotational axis, and the torsion spring applies force that generates a torque about the axis that biases the movable barrier 192 into the closed position. The hinge connects the movable barrier 192 to the bottom wall 126 of the bin 108.

During evacuation operations, a suction force is applied to the movable barrier 192. In response to the suction force, the movable barrier 192 opens and the debris inside the bin 108 is sucked out of the bin 108 and to the evacuation station 222. The evacuation of the bin 108 by the evacuation station 222 occurs autonomously without the bin 108 being removed from the mobile cleaning robot 100.

Figure 3:
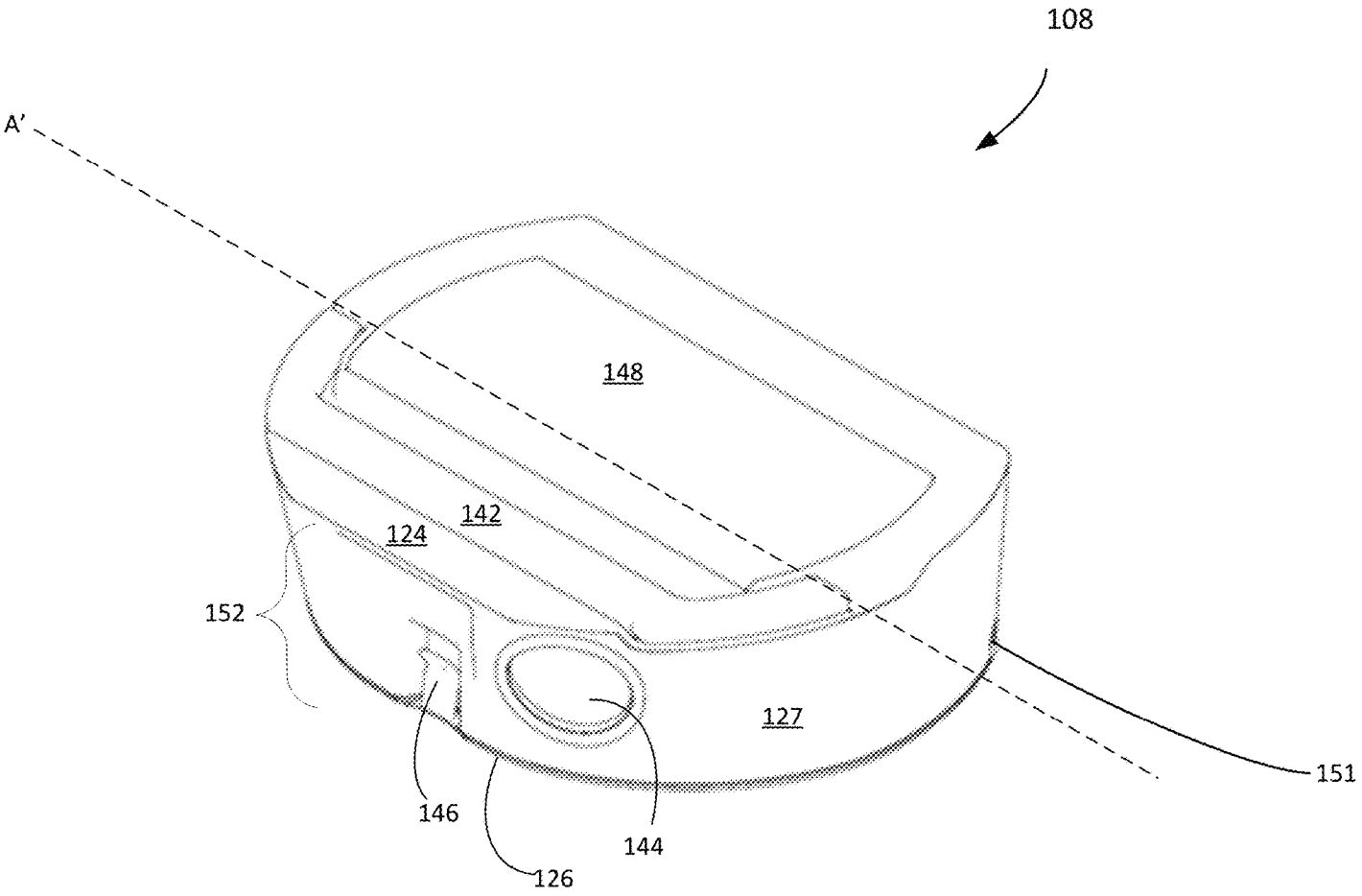
FIG. 3 is a perspective view of a n exemplary bin of the mobile cleaning robot.

FIG. 3 shows a perspective view of a bin 108 removed from the mobile cleaning robot 100. The bin 108 includes the bin 108, a handle 142, the exhaust port 144, the intake port 134, a latch 146, and a filter door 148. The bin 108 includes the sidewall 127, the top wall 124, and the bottom wall 126.

The sidewall 127 wraps around the sides of the bin 108 in a shape that is complementary to the seating 111 of the chassis (e.g., as described in relation to FIGS. 1D-1E). A rigid or semi-rigid material forms the bin 108. In some implementations, the material is transparent and debris-resistant. The sidewall 127 includes the exhaust port 144 and the intake port (not shown). In some implementations, the sidewall 127 includes one or more keyed features, such as an indent 152, that assists a user in grasping the bin 108 and that ensures properly orienting the bin 108 in the seating 111. The one or more keyed features include any number of asymmetrical features of the sidewall 127 that assist the user for orienting the bin 108 when placing the bin in the seating 111. The asymmetry of the keyed features prevents the bin 108 from rotating or shifting inside the seating 111, such as during operation of the mobile cleaning robot 100.

The top wall 124 of the bin 108 defines the volume enclosed by the bin 108, along with the sidewall 127 and the bottom wall 126 of the bin 108. In some implementations, a material forms the top wall 124 of the bin 108 that is different from the material forming the sidewall 127. For example, the material forming the top wall 124 may be non-transparent or non-rigid. In implementations, the top wall 124 includes a rigid or semi-rigid material. top wall 124*b* in 108 top wall 124 In some implementations, the top wall 124 of the bin 108 is rugged and resistant. In some implementations, the top wall 124 includes a more pliable material to facilitate removal of the top wall 124 from the bin 108. The top wall 124 affixes to the sidewall 127. In some implementations, the top wall 124 includes tabs that snap to mating slots in the sidewall 127. In some implementations, the top wall 124 is attached to the sidewall 127 using a hinge. In some implementations, the top wall 124 is molded and sealed to the sidewall 127. Other such mechanisms for affixing the top wall 124 to the sidewall 127 are possible.

A handle 142 attaches to the top wall 124 of the bin 108. The handle 142 includes a rigid or semi-rigid material, such as a plastic. In some implementations, the handle 142 attaches to the top wall 124 of the bin 108 using a hinge. The hinge or hinges used to affix the handle 142 to the top wall 124 of the bin 108 are located along an axis A' as shown in FIG. 3. In some implementations, the location of the handle hinges is chosen to be along an approximate center of mass of the bin 108 such that the bin, when hanging from the hinged handle 142, is approximately balanced and level. For example, the user can grasp the handle 142 and lift the bin 108 with a single hand without needing to balance or steady the bin with a second hand. When the user is grasping the handle 142 with a single hand to empty the bin 108, the user can extend a portion of his or her hand to depress a bin-emptying button (e.g., button 154 shown in FIG. 4) without his other hand to steady or balance the bin 108. In some implementations, the handle 142 rotates around the handle hinge from a position representing a stored state of the handle 142 to a position representing an extended state of the handle 142. When the position of the handle 142 represents the stored state of the handle 142, the handle 142 does not extend above the top wall 124 of the bin 108 or extends no more than the width of the handle 142 above the top wall 124 of the bin 108. In some implementations, the handle 142 is disposed in a recess (e.g., recess 156 shown in FIG. 4) of the top wall 124 of the bin 108 during the stored state such that the handle 142 and the top wall 124 of the bin 108 form an approximately flush surface. Such a configuration can reduce the overall volume envelope of the bin 108. The bin access panel 112 can close over the bin 108 and the handle 142 without the handle 142 protruding from the mobile cleaning robot 100.

The handle 142 can rotate from the position representing the stored state to a position representing an extended state. The handle 142 is substantially planar and extends above the top wall 124 of the bin 108 during the extended state. In some implementations, the handle 142 rotates until the substantially planar handle 142 is approximately orthogonal with the top wall 124 of the bin 108. In some implementations, the handle 142 rotates to form any angle with the top wall 124 of the bin 108. FIG. 3 shows an example bin (e.g., bin 108) with the handle 142 in the stored state.

The handle 142 can be a different color than the top wall 124 of the bin 108. The handle 142 can be colored to stand out from the rest of the bin 108 to a user. For example, when the bin is disposed in the seating 111 and the bin access panel 112 is open to expose the top wall 124 of the bin to the user, the contrasting handle 142 and top wall 124 can be seen by the user. The handle 142 can be brightly colored or otherwise contrast the top wall 124 of the bin 108. In some implementations, the handle 142 is a green color and the top 142 of the bin 108 is a black color. Other contrasting combination of colors can be used.

A filter door 148 affixes to the top wall 124 of the bin 108 to cover an opening 159 (FIGS. 6B and 6C) for accessing the second volume 132 of the bin 108 and the filter unit 136 inside. In some implementations, the filter door 148 attaches to the top wall 124 using a pressfit interface. In some implementations, the filter door 148 attaches to the top wall 124 using a hinge. In some implementations, the filter door 148 attaches to the top wall 124 using a sliding mechanism to slide shut across the opening. In some implementations, the filter door 148 screws into the top wall 124 forming a plug. In some implementations, the filter door 148 includes tabs that snap into receiving slots of the top wall 124. The filter door 148 includes a transparent material such that the filter unit 136 is visible in the bin 108 when the filter door 148 is closed. The user can determine whether the filter unit 136 needs replacing, such as if the filter unit appears saturated with debris or is otherwise failing to keep debris from entering the second volume 132. The filter door 148 is positioned to allow access to the filter unit 136 disposed in the airflow path, such that the user can replace or remove the filter unit 136 from the bin 108 without removing the top wall 124 of the bin. In some implementations, the filter door 148 includes a seal around an edge of the filter door 148 such that air is prevented from passing through the top wall 124 of the bin 108 when the filter door 148 is closed. The filter door 148 includes protrusions (e.g., protrusions 162 in FIG. 6A) that extend from the filter door 148 to mechanically engage with the top wall 124 of the bin 108 to seal the filter door 148 closed. The protrusions 162 can be made from the same material as the filter door 148 and may be formed with the filter door as a single integrated molded assembly.

Returning to FIGS. 4 and 5, the bottom wall 126 of the bin 108 forms a lower surface for the bin 108 that defines the volume enclosed by the bin, along with the sidewall 127 and the top wall 124 of the bin. In some implementations, the bottom wall 126 of the bin 108 affixes to the sidewall 127 of the bin 108 with a bottom wall hinge 151. The bottom wall 126 of the bin 108 includes a rigid, approximately planer surface. A latch 146 extends from an edge of the bottom wall 126 for releasing a non-hinged edge 135 of the bottom wall 126 of the bin 108. In some implementations, a seal (e.g., seal 145 in FIG. 4) extends around the edge of an interior surface of the bottom wall 126. The seal 145 prevents air, debris, and so forth from exiting the bin 108 through the bottom of the bin 108 when the bottom 126 of the bin 108 is fastened closed to the sidewall 127 with the latch 146.

In some implementations, the bin 108 includes a resistance mechanism (not shown) that retards (e.g., slows) opening of the bottom wall 126 of the bin 108. The resistance mechanism can include a spring, wire, or other device that slows the opening of the bottom wall 126 of the bin 108. The controlled opening of the bin 108 using the resistance mechanism reduces rapid, uncontrolled ejection of dust and debris from the bin 108 during emptying. The resistance mechanism is configured to permit the bottom wall 126 to more slowly allow debris to fall from the first volume 130 of the bin 108 than if the bottom swung open freely. A reduction in a plume of debris and dust can be achieved by controlled opening of the bottom wall 126. More debris can thus be controlled into an intended destination, such as a rubbish bin, rather than remaining in an airborne plume that might be caused by sudden release of the debris from the bin 108.

In some implementations, the bottom wall hinge 151 is a breakaway hinge. The breakaway hinge causes the bottom wall 126 of the bin 108 detach without damage to the bottom or the bin 108 when the bottom wall 126 is opened past an intended operating angle. The breakaway hinge is re-attachable to the bin sidewall 127.

Figure 10A:
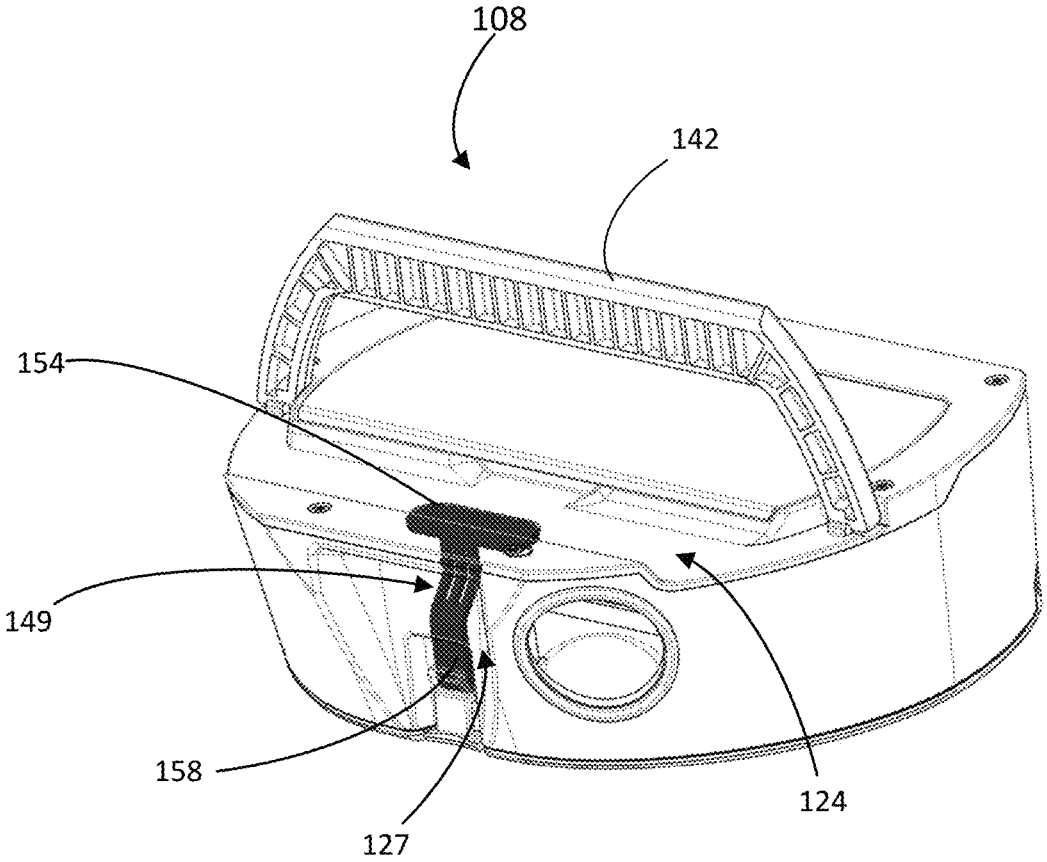
FIG. 10A is a perspective front view of a bin of an exemplary bin of the mobile robot showing a latching mechanism.
Figure 10B:
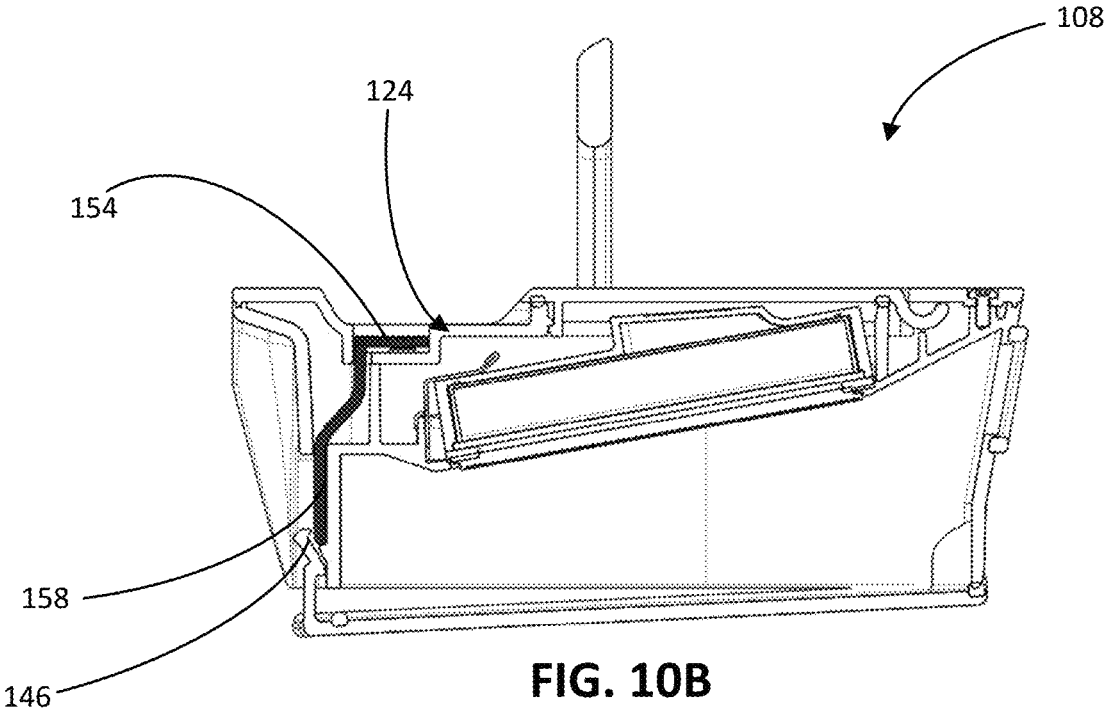
FIG. 10B is a cross section side view of an exemplary bin of the mobile robot showing a latching mechanism.

The latch 146 extends from the edge of the bottom wall 126 and can fasten over an extension arm 158 protruding from the sidewall 127 of the bin 108 when the bottom is closed (e.g., as shown in FIG. 10B). The latch 146 can be flexible such that the latch "snaps" over the extension arm 158 when the bottom wall 126 of the bin 108 is closed such that the latch 146 holds the extension arm 158 in place against the sidewall 127. In some implementations, the extension 158 is part of a button release mechanism. The button release mechanism is described below in greater detail in relation to FIGS. 10A-10B.

FIG. 10A shows a perspective view of the bin 108 including the latching mechanism (e.g., latch 146) and extension arm 158. A button release mechanism 149 includes a button 154 and an extension arm 158. The button release mechanism 149 extends through the top wall 124 of the bin 108. When the top wall 124 of the bin 108 is affixed to the sidewall 127, the button release mechanism 149 extends through the sidewall 127 of the bin 108. The extension arm 158 extends down to meet the latch 146 of the bottom wall 126 of the bin 108 and latch the bottom wall 126 of the bin 108 closed. The button 154 is approximately flush with the top wall 124, and the handle 142 obscures the button 154 from view when the handle 142 is in a stored state. When the button 154 is depressed, the button release mechanism 149 moves downward along the sidewall 127 of the bin 108, sliding out from under the latch 146 and allowing the bottom wall 126 to swing away from the bin sidewall 127.

FIG. 10B shows a side view of the bin 108, including a latching mechanism (e.g., latch 146) as the button 154 is depressed and the bottom wall 126 begins to open. The button release mechanism 149 extends through the top wall 124 of the bin 108 and includes a flat, wide extension arm 158. The extension arm 158 extends through the sidewall 127 of the bin 108 to mate with on the latch 146 on the bottom wall 126 of the bin 108. When the button 154 is pressed, the button release mechanism 149 moves toward the bottom wall 126 of the bin 108 and the bottom wall 126 of the bin 108 is allowed to swing open.

Figure 4:
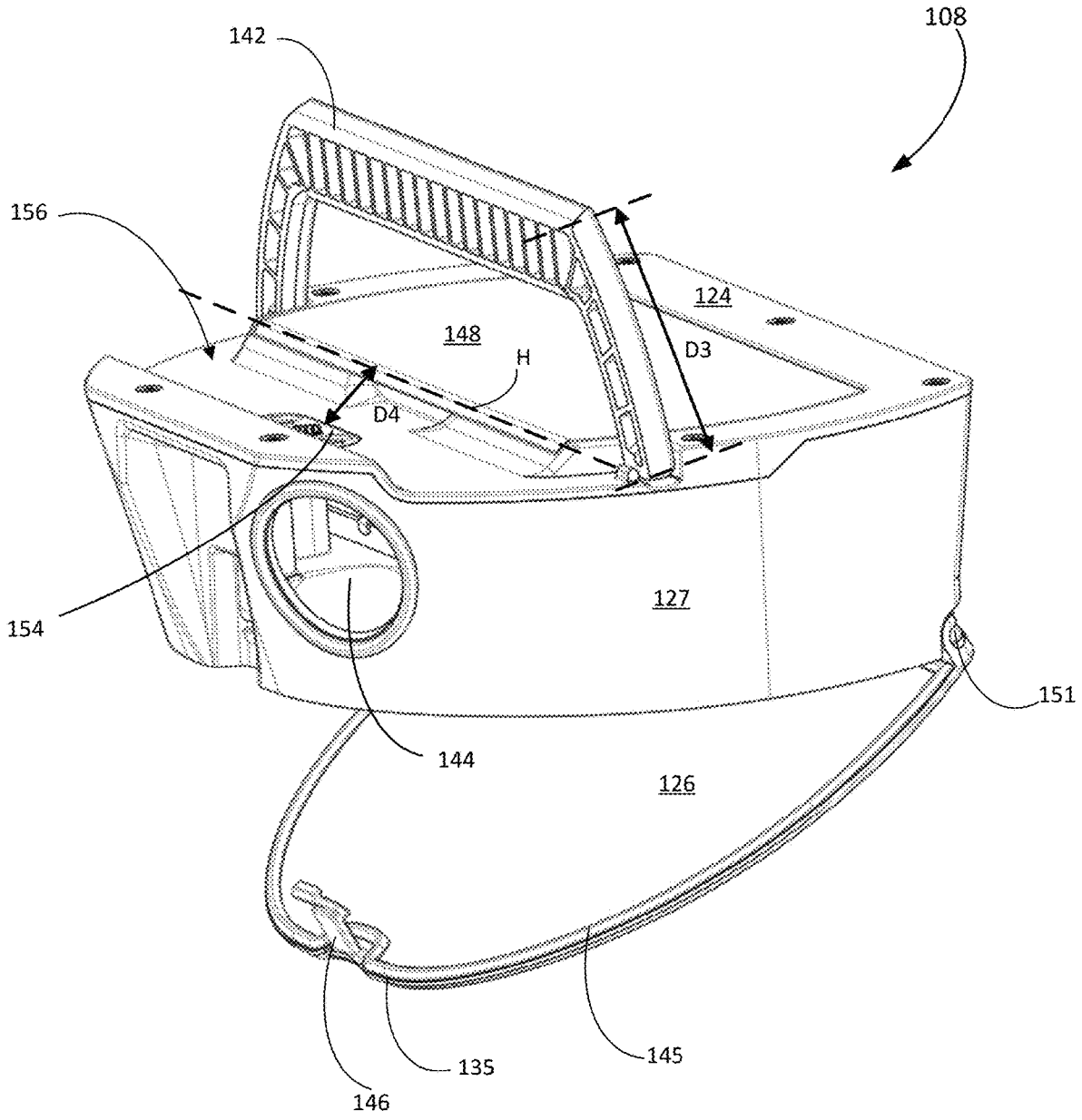
FIG. 4 is a perspective view of an exemplary bin of the mobile cleaning robot showing an extended bin handle and an open bottom wall of the bin.

FIG. 4 is a perspective view of the bin 108 removed from the mobile cleaning robot 100 showing the handle 142 and the open bottom wall 126 of a bin 108 of the bin 108. The handle 142 is shown in an extended state. The bottom wall 126 of the bin 108 is shown in an open position. When the handle 142 is in the extended state, a button 154 (e.g., a bin-emptying button) is revealed on the top of the bin 108. The button 154 is pressable from above the top of the bin 108. In some implementations, the button 154 is flush with the top wall 124 of the bin 108 in a recess 156 of the bin 108 that receives the handle 142 in the stored state. In some implementations, the button 154 is hidden by the handle 142 when the handle 142 is in the stored state. In some implementations, the handle 142 obscures the button 154 from view or otherwise covers the button 154 to reduce confusion for a user who might think that the button 154 releases the bin 108 from the seating 111. In such a configuration, when the user opens the bin 108 access panel, the user sees the top wall 124 of the bin 108, including the handle 142. Once the handle 142 is grasped or otherwise moved, the button 154 becomes visible to the user. The placement of the button 154 beneath the handle 142 prompts the user to pull the bin 108 from the seating 111 before attempting to press the button 154. In some implementations, the button 154 is a color that contrasts with the top wall 124 of the bin 108. The button 154 can be a contrasting color such the user notices the button more easily. In some implementations, button 154 can be the same color as the handle 142.

The button 154 opens a latch 146 to release the bottom wall 126 for emptying the bin 108 when the button 154 is pressed or depressed. In some implementations, the button 154 is molded as a single piece with a button extension (e.g., extension arm 158) that protrudes through the sidewall 127 from the top wall 124 of the bin 108. The button extension 194 mechanically engages the latch 146 on the bottom wall 126. For example, the button extension arm 158 and the latch 146 each include a bump or lip for engaging the other. When the button 154 is pressed, button extension arm 158 slides toward the bottom wall 126 of the bin 108 and disengages from the latch 146. When the button extension arm 158 slides toward the bottom wall 126 of the bin 108, the latch 146 that flexes over the button extension arm 158 is no longer mechanically engaged with the button extension arm 158. The bottom wall 126 is free to swing open, as shown in FIG. 4. In some implementations, the button 154 includes iconography, such pictorial icons, text, and the like, indicating the purpose of the button 154. In some implementations, the pictorial icon includes a depiction of a trash or debris bin.

As shown in FIG. 4, in some implementations, when the handle 142 is in the extended state, the handle 142 extends distance D3 from the top wall 142 of the bin 108. In some implementations, D3 is less than five (5) inches. In some implementations, D3 is between 3-5 inches. The length of distance D3 includes a distance that is long enough to allow enough clearance between the top wall 124 of the bin 108 and the handle 142 for a user's hand to grasp the handle 142 comfortably without hitting the top wall 142 of the bin 108. Additionally, the distance D3 is short enough to allow the user to extend a finger to depress the button 154 with the hand that is grasping the handle 142 without releasing the handle 142. The button 154 is located distance D4 from an axis H defined by a hinge axis of the handle 142, as shown in FIG. 4. In some implementations, D4 is less than five (5) inches. In some implementations, D4 is between 3-5 inches. In this described configuration, the button 154 and the handle 142 can be operated by one hand of a user. For example, the user may pick up the bin 108 by grasping the handle 142 with a hand and simultaneously press the button 154 to open the bottom wall 126 of the bin 108. The handle 142 is located near a center of mass of the bin 108 such that the bin 108 is balanced when suspended by the handle 142. When the bottom wall 126 opens, debris falls from the bin 108 and the bottom wall 126 hangs open from the bottom wall hinge 151, altering the balance of the bin 108 suspended from the handle 142. The handle 142 is located such that the change in the balance of the bin 108 does not significantly tilt the bin 108 when hingedly suspended from the handle 142.

FIG. 5 shows a transparent side-view of a debris bin 108 showing movement of a handle 142 and a bottom wall 126 of a bin 108 of the bin 108. Double ended arrow H-H indicates movement of a handle 142 of the debris bin 108 from a stored state to an extended state, as described above. Double ended arrow B-B indicates movement of the bottom wall 126 of the bin 108 from an open state to a closed state, as described above. The exhaust port 144 is shown that includes an exhaust port seal 160 around an edge of the exhaust port. An intake port seal 153 around the opening of the intake port 134 is shown extending from the sidewall 127 of the bin 108.

FIG. 6A shows a perspective view of a bin 108 including a placement of a filter unit 136 inside a bin 108 of the bin 108. A filter door 148 is shown in an open position, exposing the filter unit 136 inside the bin 108 (e.g., exposing the second volume 132). Protrusions 162 are shown on the filter door that are used to hold the filter door 148 in a closed position. When the filter door 148 is closed, the protrusions 162 snap into receiving slots in the top wall 124 of the bin 108. The filter door 148 includes a filter door seal 163 on the interior surface of the filter door 148. The filter door seal 163 reduces air leaks in the second volume 132. The airflow created by the blower 118 is thus directed through the filter unit 136 without substantial leaks through the top wall 124 of the bin 108.

An internal barrier (e.g., internal barrier 128) supports the filter unit 136 in the airflow path through the bin 108. In some implementations, the filter unit 136 includes a rigid pull-tab 164 protruding from a frame of the filter unit 136 for grasping and removing the filter unit 136 from the bin 108 through the filter door 148. In some implementations, the filter unit 136 is held against the internal barrier 128 using a mechanical means. The mechanical means holds the filter unit 136 in place against the internal barrier 128 such that the airflow caused by the blower 188 during cleaning operations of the mobile cleaning robot 100 does not shift the filter unit 136 out of place or unseat the filter within the second volume 132. In implementations, the mechanical means includes rear retention clip 155 for receiving the filter unit 136 in a pressfit configuration. In some implementations, the filter door 148 includes structures (not shown) that extend down from the filter door and press against the filter unit 136 to further secure the filter unit in place when the filter door 148 is secured in a closed position. The structures can be a molded portion of the filter door 148, a spring, a protrusion, and so forth. The filter unit 136 is firmly affixed to the internal barrier 128 because the filter unit 136 is pulled by the airflow moving through the filter unit. If the filter unit 136 is unseated from the internal barrier 128 during cleaning operations, airflow may bypass the filter unit 136 though a gap between the filter unit and the internal barrier 128 and allow debris to enter the second volume 132. Additionally, if the filter unit 136 is unseated from the internal barrier 128 during cleaning operations, the airflow path 107 from the blower 118 may be blocked, constricted, or impeded.

FIGS. 6B-6C shows the bin 108 from above having the filter unit 136 removed and an exploded view of a configuration of the filter unit 136 and a prescreen filter 168. The internal barrier 128 includes a platform 169 for positioning the filter unit 136 in the airflow path. A mechanical means holds the filter unit 136 in place against the internal barrier. In some implementations, one or more leaf springs 170 are affixed in the second volume 132 of the bin 108 of the bin 108. The one or more mechanically compressible. leaf springs 170 are mounted within the second volume 132 proximate to the lower end of the internal barrier 128. In some implementations, the one or more leaf springs 170 are affixed to an aft filter cavity sidewall 157A in the second volume 132. The one or more leaf springs 170 are biased to extend outwardly from the aft filter cavity sidewall 157A but can be compressed to be approximately flush with the aft filter cavity sidewall 157A. The one or more leaf springs 170 include approximately planar extensions that are flexible. The one or more leaf springs 170 can be made of a semi-rigid material configured to flex without deforming, such as a metal tab. The one or more leaf springs 170 exert a retention force on the filter unit 136 when the filter unit is placed on the internal barrier 128. The one or more leaf springs 170 are compressed and sandwiched between the filter unit 136 and the aft filter cavity sidewall 157A. For example, referring to FIG. 6C, the one or more leaf springs 170 exert a force on the filter unit, compressing the filter unit 136 against a forward filter cavity sidewall 157F shown in FIG. 6B.

Figure 7:
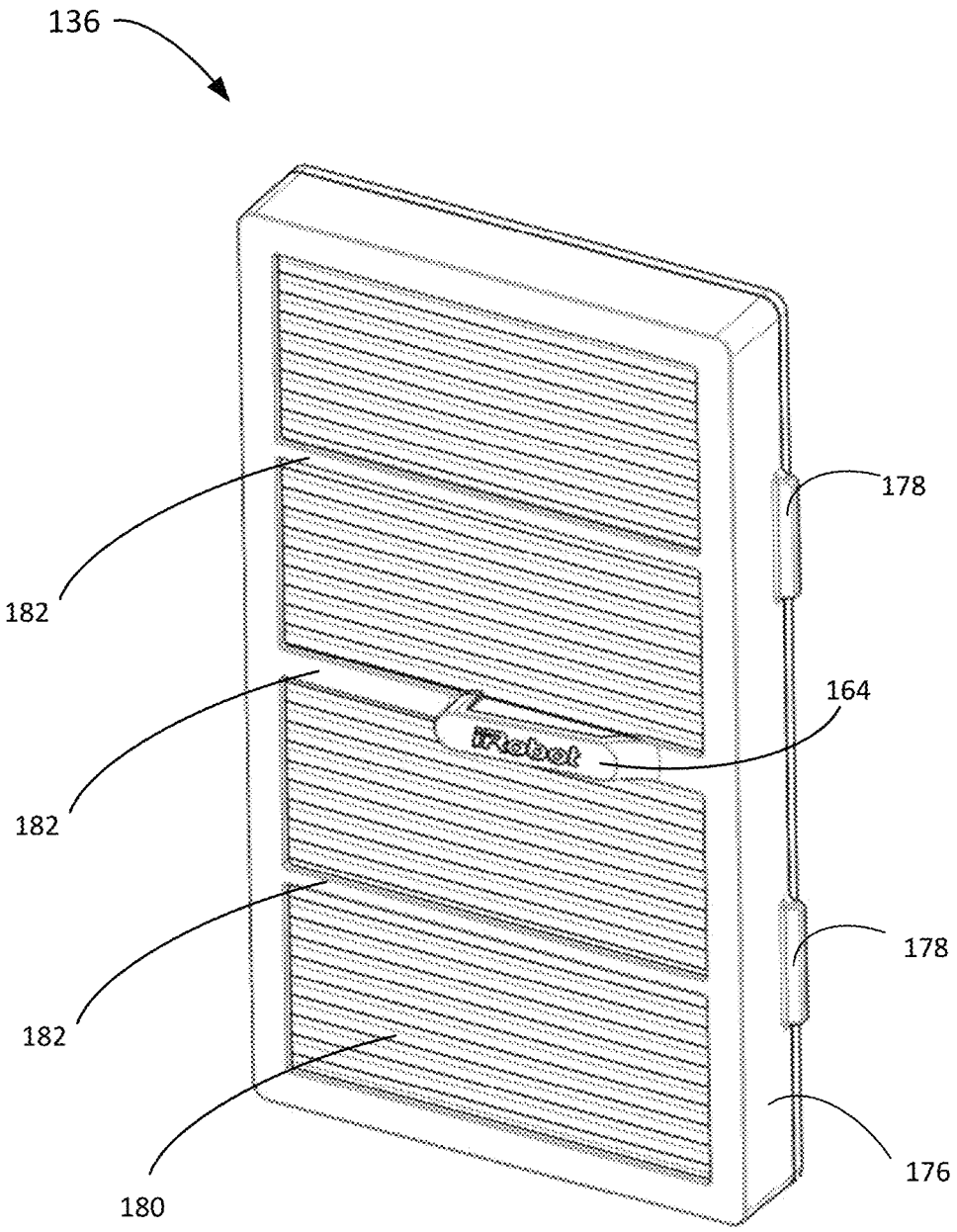
FIG. 7 is a perspective top view of an exemplary filter unit.

The filter unit 136 includes integrated protrusions or tabs 178, as shown in FIG. 7, that are inserted into receiving slots 174 in the forward filter cavity sidewall 157F, as depicted in FIG. 6B. In some implementations, the tabs 178 are wedge-shaped tabs. When the one or more leaf springs 170 exert the force on the filter unit 136, the wedge-shaped tabs force the filter unit 136 against the aft filter cavity sidewall 157A to further position the filter unit 136 firmly or securely onto the internal barrier 128. Other such mechanical means for holding the filter unit 136 in place on the internal barrier 128 can be used, such as friction, a snapfit, coil springs, adhesive, screws, and so forth. To remove the filter unit 136 from the bin 108, the user can pull the pull-tab 164 to compress the one or more leaf springs 170 and then lift the tabs away from the receiving slots 174.

Figure 6F:
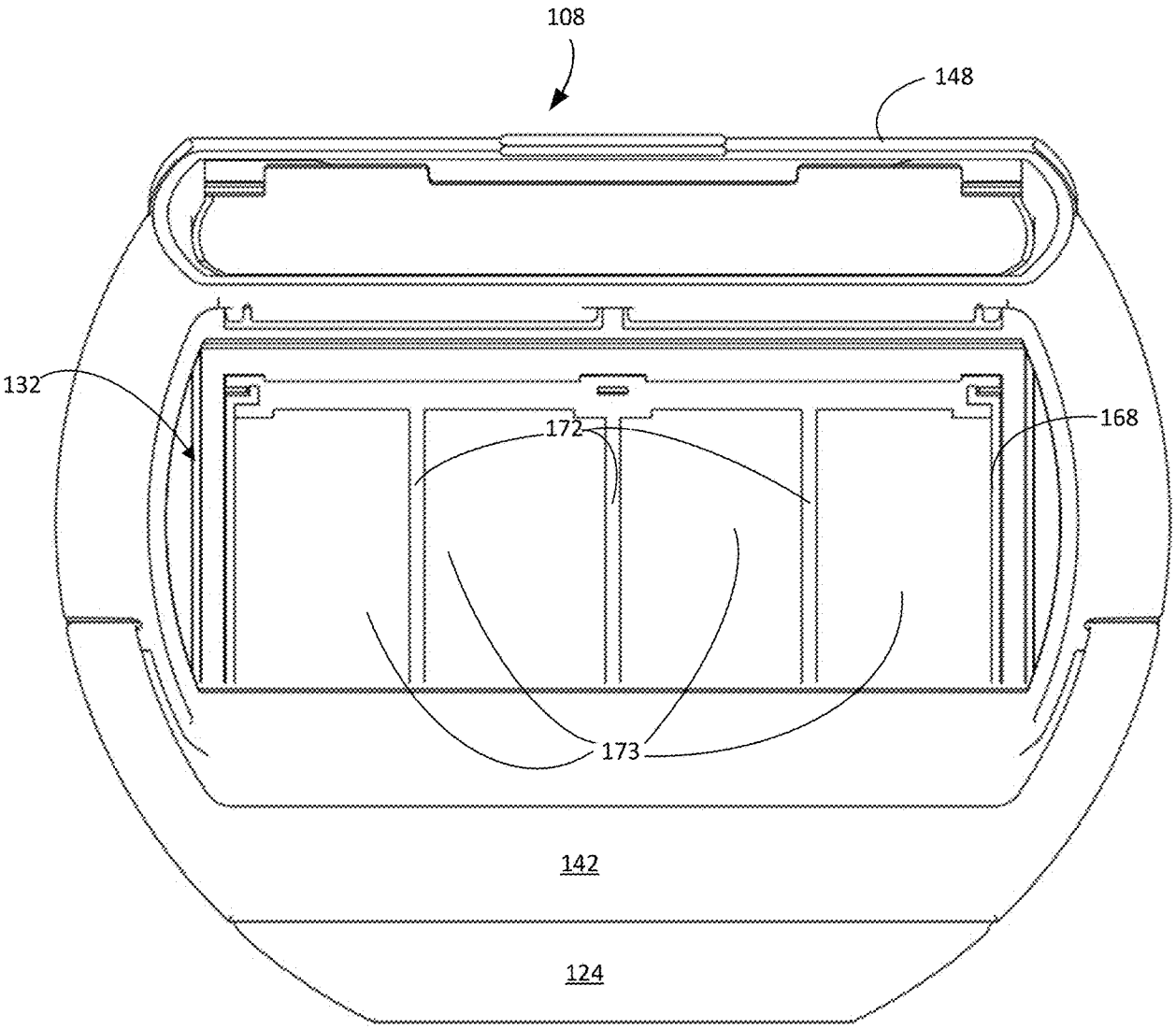
FIG. 6F depicts a top view of the exemplary bin of FIG. 6A showing a prescreen filter inside the bin.

A prescreen filter 168 can be placed in the airflow path 107 between the first volume 130 and the filter unit 136. The prescreen filter 168 prevents a portion of the debris from reaching the filter unit 136 (e.g., for extending the span of use of the filter unit 136). Additionally, the prescreen filter 168 can facilitate cleaning of the bin 108 because it can be removed and wiped or rinsed. In some implementations, the prescreen filter 168 is disposed beneath the filter unit 136 and affixed to the internal barrier 128 in the airflow path 107 between the first volume 130 and the second volume 132 of the bin 108. In implementations, as shown in FIG. 6F, the prescreen filter 168 forms a portion of the internal barrier 128 and includes a plurality of struts 172 for supporting the filter unit 136 thereon. In some implementations, the prescreen filter 168 includes a light mesh material 173 that covers a prescreen frame 171 that is approximately the same cross sectional size shape as the filter unit 136. The mesh material 173 permits air to pass through the prescreen filter 168 but prevents most debris from passing through the prescreen filter 168. In some implementations, the mesh material 173 is rigid or semi-rigid mesh material, such as a metal or plastic screen. In some implementations, the prescreen filter 168 provides a barrier between the filter unit 136 and the first volume 130 in the airflow path 107. Because debris (e.g., larger debris) in the first volume 130 does not cling to filter material in the filter unit 136 and block the airflow, the prescreen filter 168 extends a lifespan of use for the filter unit 136 and improves suction performance of the mobile cleaning robot 100 on a cleaning surface.

The prescreen filter 168 is placed between the first volume 130 and the filter unit 136 in the airflow path. In some implementations, the internal barrier 128 includes a lip or other mechanism for retaining the prescreen filter 168. In some implementations, the prescreen filter 168 is placed over an aperture 175 (FIG. 6C) in the internal barrier 128 that is slightly smaller in dimension than the prescreen filter 168. In some implementations, the aperture 175 in the internal barrier 128 includes one or more support beams (not shown) on which the filter unit 136 or the prescreen filter 168 rest. The filter unit 136 can be disposed on top of the prescreen filter 168 to hold the prescreen filter 168 in place. In some implementations, the prescreen filter 168 exposes only the mesh material 173 (and not the prescreen frame 171) such that no corners that can trap debris are exposed to the first volume 130. The prescreen filter 168 can be cleaned after use. Debris that is clinging to the prescreen filter 168 after use can be wiped off the prescreen filter 168 to clean the prescreen filter 168 or rinsed off the prescreen filter 168 (e.g., with a solvent).

FIG. 7A shows a perspective view of a filter unit 136. The filter unit 136 includes a frame 176. The frame 176 includes a rigid material, such as a plastic, that includes tabs 178. A mechanical means holds the frame 176 onto the internal barrier using techniques such as those described in relation to FIG. 6B.

A pull-tab 164 protrudes from the frame 176. The pull-tab 164 can be a molded portion of the frame 176, such as comprising the rigid material of the frame 176. In some implementations, the pull-tab 164 protrudes from the filter unit 136 near the center of the filter unit 126. The pull-tab 164 is sized to be grasped by a user for removal of the filter unit 126 from the bin 108. By grasping the pull-tab 164, the user can pull the filter unit 126 from the leaf springs 170 that hold the filter unit 126 in place on the internal barrier 128, affixed within the second volume 132.

The filter unit 136 is mechanically affixed to the internal barrier 128 using the tabs 178. The tabs 178 integrate with receiving slots 174 in the sidewall 127 to affix the filter unit 136 in place during operation of the mobile cleaning robot 100, as described in reference to FIG. 6B. When the pull-tab 164 is pulled, the filter unit 136 tilts and the tabs 178 are released from the slots 174. The pull-tab 164 is large enough to be grasped firmly by a user such that the user can pull on the filter unit 136 with enough force to overcome the retention force of the one or more leaf springs 170. The pull-tab 164 is located on the filter unit 136 so that the filter unit can evenly be pulled from the retention force of the leaf springs 170 without excessive torsion forces on the filter unit 136. In some implementations, the pull-tab 164 is located near the center of the filter unit 136. When the filter unit 136 is pulled by the pull-tab 164, the filter unit 136 is pivoted. The frame 176 is lifted from the internal barrier 128 and slides or rides against the leaf springs 170. The tabs 178 are able to rotate free of the receiving slots 174. When the filter unit 136 clears the leaf springs 170 (e.g., slips free of the retention force), the leaf springs 170 are able to decompress. The filter unit 136 is lifted free of the retention force and can be pulled from the internal barrier 128 through the opening 159 in top wall 124 of the bin 108. The filter unit 136 can thus be removed from the bin 108, revealing the second volume 132, or filter cavity, and a filter cavity sidewall 157.

The frame 176 includes two or more beams 182 supporting the filter material 180 in the filter unit 136. The beams 182 are narrow and spaced to retain the filter material 180 in the frame 176 without substantially blocking the airflow. In some implementations, the filter material 180 includes a fibrous material that allows air to pass through the material but traps dust, debris, etc. The filter material traps small, fine particles of debris that are not trapped or blocked by the prescreen filter 168. In some implementations, the filter material 180 includes folds that increase the surface area of the filter material exposed to the airflow path. The filter material 180 covers the entire airflow path through the filter unit 136.

The robots described herein can be controlled, at least in part, using one or more computer program products, e.g., one or more computer programs tangibly embodied in one or more information carriers, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment.

Operations associated with controlling the robots described herein can be performed by one or more programmable processors executing one or more computer programs to perform the functions described herein. Control over all or part of the robots and evacuation stations described herein can be implemented using special purpose logic circuitry, e.g., an FPGA (field programmable gate array) and/or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only storage area or a random access storage area or both. Elements of a computer include one or more processors for executing instructions and one or more storage area devices for storing instructions and data. Generally, a computer will also include, or be operatively coupled to receive data from, or transfer data to, or both, one or more machine-readable storage media, such as mass PCBs for storing data, e.g., magnetic, magneto-optical disks, or optical disks. Machine-readable storage media suitable for embodying computer program instructions and data include all forms of non-volatile storage area, including by way of example, semiconductor storage area devices, e.g., EPROM, EEPROM, and flash storage area devices; magnetic disks, e.g., internal hard disks or removable disks; magneto-optical disks; and CD-ROM and DVD-ROM disks.

Although a few implementations have been described in detail above, other modifications are possible. Moreover, other mechanisms for the mobile cleaning robot 100 may be used. Accordingly, other implementations are within the scope of the following claims.

What is claimed is:

1. A mobile cleaning robot, comprising:

a drive system for navigating the mobile cleaning robot on a surface;

a cleaning head configured to collect debris from the surface;

a blower; and a bin configured to receive airflow pulled through the bin from the cleaning head by the blower, the bin comprising:

a top of the bin, a bottom of the bin, and a sidewall;

a filter unit removably disposed in an airflow path between an intake port in the sidewall and an exhaust port in the sidewall; and a hinge affixing the bottom of the bin to the sidewall and enabling the bottom of the bin to open.

2. The mobile cleaning robot of claim 1, comprising a button-actuated latch for releasing a non-hinged edge of the bottom of the bin.

3. The mobile cleaning robot of claim 1 in which the bin further comprises a resistance mechanism configured to retard opening of the bottom of the bin.

4. The mobile cleaning robot of claim 1 in which the hinge is a breakaway hinge that enables the bottom of the bin to detach from the sidewall without damage to the bottom of the bin or to the sidewall when the bottom of the bin is opened beyond an operating angle, and the bottom is subsequently re-attachable.

5. The mobile cleaning robot of claim 1 in which the bottom of the bin further comprises an evacuation port including a movable barrier for evacuation of contents of the bin.

6. The mobile cleaning robot of claim 5 in which the movable barrier is configured to open when a suction force is applied to the movable barrier from outside of the bin.

7. The mobile cleaning robot of claim 5, comprising an aperture for exposing a portion of the bottom of the bin, in which the evacuation port aligns with the aperture when the bin is in the robot.

8. The mobile cleaning robot of claim 1 in which the bin comprises a seal extending around an edge of the bottom of the bin, and the seal prevents air from passing between the sidewall and the bottom of the bin when the bottom of the bin is closed.

9. The mobile cleaning robot of claim 1 in which the bin comprises a keyed feature that aligns with a keyed feature for placement of the bin in the mobile cleaning robot.

10. A mobile cleaning robot, comprising:

a drive system for navigating the mobile cleaning robot on a surface;

a cleaning head configured to collect debris from the surface;

a blower; and a bin supported by a seating that comprises a keyed feature for orienting placement of the bin in the seating, in which the bin is removable from a top of the mobile cleaning robot and configured to receive airflow pulled through the bin from the cleaning head by the blower, wherein the bin comprises a handle that is visible and obscures a bin-emptying button of the bin when the bin is placed in the seating, and the handle is affixed to the bin with a hinge.

11. The mobile cleaning robot of claim 10 in which the seating comprises an aperture for exposing the bin for external evacuation of the debris from the bin, the bin further comprises an evacuation port, and the aperture is aligned with the evacuation port of the bin when the bin is placed in the seating.

12. The mobile cleaning robot of claim 10, comprising a bin access panel that covers the bin when the bin is properly seated in the seating, in which the bin access panel is ajar when the bin is improperly seated in the seating.

13. The mobile cleaning robot of claim 10 in which the seating comprises a mechanism that provides tactile feedback when the bin is properly inserted into the seating.

14. The mobile cleaning robot of claim 13 in which the tactile feedback comprises a sound.

15. The mobile cleaning robot of claim 10 in which a sidewall of the bin comprises a shape feature configured to match the keyed feature of the seating, the sidewall is angled to match a tapered sidewall of the seating, and the tapered sidewall guides insertion of the bin into the seating.

16. The mobile cleaning robot of claim 15 in which the shape feature comprises an indent in the sidewall of the bin.

17. The mobile cleaning robot of claim 10 in which the seating is approximately at a center of the mobile cleaning robot.

18. The mobile cleaning robot of claim 10 in which the bin comprises a filter door that is visible when the bin is placed in the seating, and the filter door enables access to a filter unit of the bin when the bin is placed in the seating.

19. A method of operating a mobile cleaning robot, the method comprising:

navigating the mobile cleaning robot on a surface;

collecting debris from the surface using a cleaning head of the robot; and receiving airflow at a bin disposed in the robot in which the airflow is pulled through the bin from the cleaning head by a blower disposed in the robot, and the bin comprises:

a top of the bin, a bottom of the bin, and a sidewall;

a filter unit removably disposed in an airflow path between an intake port in the sidewall and an exhaust port in the sidewall; and a hinge affixing the bottom of the bin to the sidewall and enabling the bottom of the bin to open.

20. The method of claim 19, further comprising:

releasing a non-hinged edge of the bottom of the bin when a button-actuated latch is actuated.

21. The method of claim 19, further comprising:

restricting opening of the bottom of the bin using a resistance mechanism of the bin.

22. The method of claim 19, further comprising:

detaching the bottom of the bin from the sidewall without damage to the bottom of the bin or to the sidewall when the bottom of the bin is opened beyond an operating angle using a breakaway hinge.

23. The method of claim 22, further comprising:

reattaching the bottom of the bin to the sidewall.

24. The method of claim 19, further comprising:

moving a movable barrier for evacuation of contents of the bin, the barrier located in an evacuation port in the bottom of the bin.

25. The method of claim 19, wherein the movable barrier is configured to open when a suction force is applied to the movable barrier from outside of the bin.

26. The method of claim 19, further comprising:

aligning an aperture with the evacuation port when the bin is in the robot, the aperture to expose a portion of the bottom of the bin.

27. The method of claim 19, further comprising:

limiting air from passing between the sidewall and the bottom of the bin when the bottom of the bin is closed using a seal extending around an edge of the bottom of the bin.

* * * * *